US007611813B2

(12) United States Patent
Ida et al.

(10) Patent No.: US 7,611,813 B2
(45) Date of Patent: Nov. 3, 2009

(54) TONER AND IMAGE FORMING METHOD

(75) Inventors: Tetsuya Ida, Mishima (JP); Takeshi Ootsu, Susono (JP); Koh Ishigami, Mishima (JP); Naoki Okamoto, Mishima (JP); Nozomu Komatsu, Susono (JP); Noriyoshi Umeda, Susono (JP); Yoshinobu Baba, Yokohama (JP); Takayuki Itakura, Mishima (JP); Takeshi Naka, Susono (JP); Hirohide Tanikawa, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 452 days.

(21) Appl. No.: 11/668,554

(22) Filed: Jan. 30, 2007

(65) Prior Publication Data

US 2007/0122727 A1 May 31, 2007

Related U.S. Application Data

(63) Continuation of application No. PCT/JP2006/322276, filed on Nov. 8, 2006.

(30) Foreign Application Priority Data

Nov. 8, 2005 (JP) ..... 2005-323390

(51) Int. Cl.
*G03G 9/00* (2006.01)

(52) U.S. Cl. ..... 430/108.3; 430/111.4; 430/110.3; 430/124.1

(58) Field of Classification Search ..... 430/108.3, 430/111.4, 110.3, 124.1
See application file for complete search history.

(56) References Cited

U.S. PATENT DOCUMENTS

| | | | | |
|---|---|---|---|---|
| 7,272,348 | B2 * | 9/2007 | Okamoto et al. | 399/269 |
| 2005/0100808 | A1 | 5/2005 | Hashimoto et al. | |
| 2006/0121379 | A1 | 6/2006 | Dojo et al. | |

FOREIGN PATENT DOCUMENTS

| | | |
|---|---|---|
| JP | 08179549 | 7/1996 |
| JP | 2001166535 | 6/2001 |
| JP | 2003043738 | 2/2003 |
| JP | 2003207921 | 7/2003 |
| JP | 2004212540 | 7/2004 |
| JP | 2004-340983 | 12/2004 |
| JP | 2005157318 | 6/2005 |
| JP | 2005157343 | 6/2005 |
| JP | 2005300609 | 10/2005 |

* cited by examiner

*Primary Examiner*—Mark A Chapman
(74) *Attorney, Agent, or Firm*—Fitzpatrick, Cella, Harper & Scinto

(57) ABSTRACT

Provided a toner including at least: toner particles each containing at least a binder resin, a release agent, and a colorant; and an inorganic fine powder, in which: a degree of aggregation Y1 at a time of compression (200 kpa) of the toner satisfies a relationship of $15 \leqq Y1 \leqq 35$, and a degree of aggregation Y2 at a time of non-compression of the toner satisfies a relationship of $7 \leqq Y2 \leqq 15$; and a highest endothermic peak of the toner is present in a temperature range of 30 to 200° C. in an endothermic curve measured with a differential scanning calorimeter (DSC), and a peak temperature Tsc (° C.) of the highest endothermic peak satisfies a relationship of $60 \leqq Tsc \leqq 130$.

4 Claims, 4 Drawing Sheets

TONER AND IMAGE FORMING METHOD

BACKGROUND OF THE INVENTION

1. Field of the Invention

The present invention relates to a toner used in an electrophotographic method, an electrostatic recording method, an electrostatic printing method, or a recording method according to a toner-jet mode, and to an image forming method.

2. Description of the Related Art

In today's circumstances where there is a world wide, crying need for a reduction in amount of emission of $CO_2$, a technique concerning energy savings has started to be essential. At present, most electric power has been used in a fixing device in a copying device or printer. The use of on-demand fixation that requires small electric power is effective for a reduction in amount of emission of $CO_2$. Such on-demand fixation becomes low-temperature fixation because the on-demand fixation is performed by using a small quantity of heat. In addition, the size and weight of a fixing unit must be reduced in order that the fixing unit may be warmed by using a small quantity of heat. Accordingly, it is difficult to maintain a fixation pressure comparable to a conventional one, with the result that the on-demand fixation becomes low-pressure fixation. Toner has been improved by various approaches in terms of the physical properties of the toner in order that such fixation at low temperature and low pressure may be performed. Of those approaches, a reduction in melting point of a release agent is considered to be effective. However, the use of toner containing a release agent having a low melting point has involved problems such as reductions in development stability and image quality. In particular, a "void" in which part of a thin line becomes void is apt to occur, so the alleviation of the void is necessary. Investigation has been conducted also on the problem of the "void" by various approaches in terms of the physical properties of toner. In recent years, the use of spherical toner has been proposed.

In addition, the digitalization of data has advanced in recent years, so not only the exchange of electronic data but also the reading and digitalization of analog data by using an instrument have been vigorously performed. The kinds of reading instruments cover a broad spectrum including a portable phone and a bar code reader. In a situation where such read symbol is outputted to a medium by using a copying device or a printer and utilized, thin line reproducibility higher than the conventional one is requested nowadays. Meanwhile, the kinds of media to which read symbols are outputted also cover a broad spectrum, so a technique capable of corresponding to output to various media is also important. A technique involving the use of an intermediate transfer member in a transfer step is an example of such technique. However, when an intermediate transfer member is used, the number of times of transfer increases, so a phenomenon in which toner scatters, so called "scattering" is apt to occur. As a result, thin line reproducibility tends to be poor. An improvement has been conducted by various approaches in terms of the physical properties of toner in order that the "scattering" may be alleviated. However, a method of increasing a circularity, the method being effective against the "void", involves, for example, a problem in that the method is adversely apt to be an aggravating factor of the "scattering".

In such technical background, at present, toner which: is effective for both the alleviation of a "void" upon low-temperature, low-pressure fixation and the alleviation of "scattering" in a step involving the use of an intermediate transfer member; and shows excellent development stability has been requested. There has been proposed, for example, the suppression of fusion between toner and a member as a technique for improving development stability (JP3002063B). However, it cannot be said that the toner proposed in the document is sufficiently effective against "scattering", though the toner shows a small degree of aggregation under compression and is considered to be effective for the alleviation of a "void". In addition, there has been proposed, for example, a toner the degree of aggregation of which under compression is specified as a technique for alleviating a "void" (JP 10-171151 A). However, it cannot be said that the toner is sufficiently effective for the alleviation of the "void". Moreover, it cannot be said that the toner is sufficiently effective against "scattering". The toner is considerably susceptible to improvement particularly in a system using an intermediate transfer member.

SUMMARY OF THE INVENTION

Problems to be Solved by the Invention

Image formation in an electrophotographic technique is generally constituted of a development step, a transfer step, and a fixation step. "Scattering" occurs mainly in each of the development step and the transfer step while a "void" occurs mainly in the transfer step.

In the development step, toner is considered to be liberated from a sleeve or a carrier by a developing bias to fly to a drum having an electrostatic latent image while reciprocating in, if present, an alternating electric field. In this case, when fluidity is excessively high, part of the toner laminated on the electrostatic latent image is considered to scatter to the periphery of the electrostatic latent image as if it spilled from the toner.

In the transfer step, transfer is performed by pressing a toner layer formed on the drum against a transfer roller through an intermediate transfer member or a transfer material. When the mobility of the toner is excessively high at the time of compression, the toner layer is collapsed by a pressure upon transfer, with the result that considerable "scattering" occurs. Further, a system using an intermediate transfer member involves a secondary transfer step where all colors are collectively transferred onto a transfer material. The system has a larger number of transfer steps than that of a system using no intermediate transfer member, so an additionally large amount of "scattering" occurs. On the other hand, when the toner is apt to solidify at the time of compression, the toner solidifies owing to a pressure upon transfer to remain on the drum, with the result that a "void" occurs.

In the fixation step, when the mobility of the toner is excessively low or the melting point of the toner is excessively high at the time of the compression of the toner, the toner remains on a transfer material, with the result that a "void" occurs. In particular, in the case of low-temperature, low-pressure fixation, this phenomenon is apt to occur because the toner is hardly fixed to a recording medium.

In view of the foregoing, an object of the present invention is to provide a toner effective for the alleviation of a "void" and "scattering" in each of the above steps. Another object of the present invention is to provide a toner excellent in image stability even in image formation including a transfer step involving the use of an intermediate transfer member or a low-temperature, low-pressure fixation step.

Means for Solving the Problems

The inventors of the present invention have made extensive studies with a view to achieving the above objects. As a result, the inventors have found that a degree of aggregation at the time of non-compression, a degree of aggregation at the time of compression, and the peak temperature of a highest endothermic peak measured with a differential scanning calorimeter (DSC) among parameters representing toner physical properties are involved in scattering or a void.

That is, the constitution of the present invention is as described below.

The present invention provides a toner including at least: toner particles each containing at least a binder resin, a release agent, and a colorant; and an inorganic fine powder, in which: (i) a degree of aggregation Y1 at a time of compression (200 kpa) of the toner satisfies a relationship of 15≦Y1≦35, and a degree of aggregation Y2 at a time of non-compression of the toner satisfies a relationship of 7≦Y2≦15; and (ii) a highest endothermic peak of the toner is present in a temperature range of 30 to 200° C. in an endothermic curve measured with a differential scanning calorimeter (DSC), and a peak temperature Tsc (° C.) of the highest endothermic peak satisfies a relationship of 60≦Tsc≦130.

The present invention further provides an image forming method including: a charging step of charging an image bearing member; a latent image formation step of forming an electrostatic latent image on the image bearing member charged in the charging step; a development step of developing the electrostatic latent image formed on the image bearing member with toner to form a toner image; a transfer step of transferring the toner image on the image bearing member onto a transfer material through an intermediate transfer member; and a fixation step of fixing the toner image to the transfer material by bringing the toner image into press contact with the transfer material at a fixation nip portion, in which: a contact pressure at the fixation nip portion is 5.0 to 11.0 N/m$^2$; and the above toner is used as the toner.

EFFECT OF THE INVENTION

According to the present invention, there can be provided a toner which: is effective for the alleviation of a "void" and "scattering" in each step of image formation; and shows excellent development stability.

DESCRIPTION OF THE EMBODIMENTS

A toner of the present invention is characterized in that a degree of aggregation Y1 at the time of compression satisfies the relationship of 15≦Y1≦35.

A degree of aggregation is a value determined from remaining amounts on three kinds of screens having different apertures as a result of screening using the respective screens. In the present invention, the degree of aggregation refers to a value calculated by a method of measuring a degree of aggregation to be described later. In the present invention, the degree of aggregation Y1 at the time of compression is a degree of aggregation when a pressure of 200 kPa is applied. In an actual transfer step, a pressure to be applied to a toner layer at the time of transfer fluctuates owing to various factors during operation such as a difference in circumferential speed between a drum and an intermediate transfer member, and the width of an image formed on the drum in addition to a simple pressure at a transfer nip at the time of standstill. Accordingly, it is difficult to specify the physical properties of the toner with the aid of a degree of aggregation when an actual pressure is applied. If it is assumed that a pressure is uniformly applied to a flat member having no toner layer, a pressure at the transfer nip is about 10 to 30 kpa. If it is assumed that the flat member have a toner layer, an applied pressure increases. In view of the foregoing, the inventors have considered that the specification of a numerical range when a pressure of 200 kPa is applied to the toner in correlation with "scattering" is effective in the present invention. A specific compression method will be described later. In the present description, a degree of aggregation Y2 at the time of non-compression is the degree of aggregation of the toner before the above compression is performed.

Figure 1:
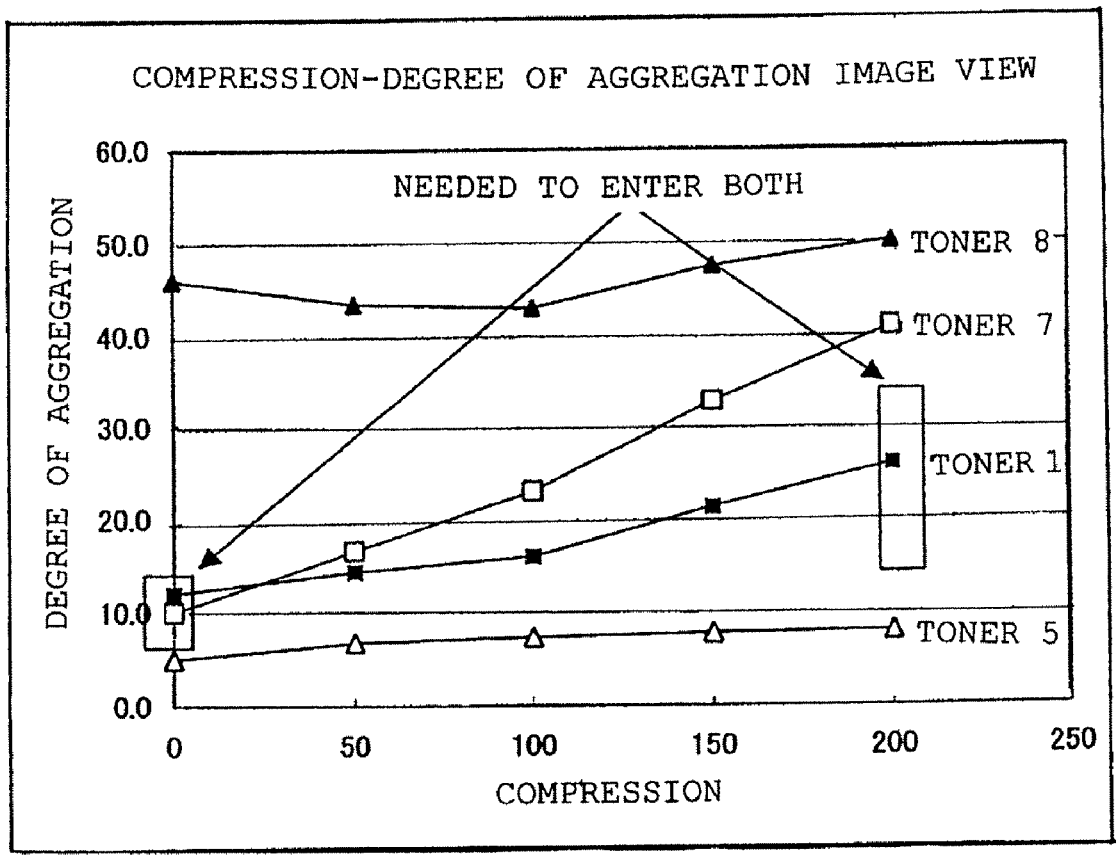
FIG. 1 is a view showing the degrees of aggregation at the time of compression and at the time of non-compression of each of a toner of the present invention and a toner of a comparative example.

The degree of aggregation Y1 at the time of compression of the toner satisfies the relationship of Y1≦35, or preferably satisfies the relationship of Y1≦30 (see FIG. 1). When the degree of aggregation at the time of compression is within the above range, the toner can be prevented from solidifying even when the toner is compressed in a transfer step. In addition, the occurrence of a void due to the remaining of the toner on an image bearing member (such as a photosensitive drum) can be suppressed. In addition, Y1 satisfies the relationship of Y1≧15. When Y1 is within the range, the scattering of the toner due to the collapse of the toner layer at the time of the compression of the toner in the transfer step or a fixation step can be suppressed.

The toner of the present invention is characterized in that the degree of aggregation Y2 at the time of non-compression satisfies the relationship of 7≦Y2≦15.

Y2 described above satisfies the relationship of Y2≧7, or preferably satisfies the relationship of Y2≧9 (see FIG. 1). When the degree of aggregation at the time of non-compression is within the above range, scattering occurring when the toner flies to a drum in a development step can be suppressed. In addition, Y2 satisfies the relationship of Y2≦15. In the case of Y2>15, it becomes difficult to stir the toner in a developing unit because the fluidity of the toner is poor. In particular, in a replenishment type device, the rise up of charging of replenished toner is poor, so fog is apt to occur.

The degrees of aggregation Y1 and Y2 can be obtained by appropriately adjusting a pulverization method at the time of production and the components of the toner. In addition, for example, such adjustment that the circularity of the toner satisfies a specific requirement is also effective means.

When the average circularity of toner each having a circle-equivalent diameter of 2.00 μm or more is represented by R, the average circularity of toner each having a circle-equivalent diameter in the range of 2.00 μm or more to less than 3.00 μm is represented by r(a) the average circularity of toner each having a circle-equivalent diameter in the range of 3.00 μm or more to less than 6.92 μm is represented by r(b), and the average circularity of toner each having a circle-equivalent diameter in the range of 6.92 μm or more to less than 12.66 μm is represented by r(c), R, r(a), r(b), and r(c) described above preferably satisfy relationships represented by expressions (1) to (4):

$$0.940 \leqq R \leqq 0.970 \quad \text{Ex. (1)}$$

$$R-0.015 \leqq r(a) \leqq R+0.015 \quad \text{Ex. (2)}$$

$$R-0.015 \leqq r(b) \leqq R+0.015 \quad \text{Ex. (3)}$$

$$R-0.015 \leqq r(c) \leqq R+0.015 \quad \text{Ex. (4).}$$

r(a), r(b), and r(c) more preferably satisfy relationships represented by expressions (5) to (7):

$$R-0.007 \leqq r(a) \leqq R+0.007 \quad \text{Ex. (5)}$$

$$R-0.007 \leqq r(b) \leqq R+0.007 \quad \text{Ex. (6)}$$

$$R-0.007 \leqq r(c) \leqq R+0.007 \quad \text{Ex. (7).}$$

An average circularity is the average value of circularities. A circularity is an indicator representing the degree of irregularities of a particle. When a particle is a perfect spherical shape, the circularity shows 1.000. As the surface shape of the particle becomes more complicated, the circularity shows a smaller value. A method of measuring an average circularity will be described later.

When the average circularities of toner are adjusted to satisfy the above relationships, it becomes easy to satisfy a requirement concerning a degree of aggregation. In addition, a void and scattering can be alleviated more excellently. Toner having a low average circularity has a high degree of irregularities on the surface of a particle. In such toner, an inorganic fine powder is apt to be unevenly distributed to a recess, and is apt to be absent in a projection. In the case where the inorganic fine powder shows such distributed state, when the toner receives a high pressure in, for example, a transfer step, the toner is apt to aggregate, and is apt to adhere to an image bearing member to cause a void. In addition, when an average circularity is excessively high, the mobility of toner is apt to be high, so scattering is apt to occur. In addition, it is important to adjust not only the average circularity of the entire toner but also the average circularity of toner in each region, that is, each of a coarse powder band, an intermediate powder band, and a fine powder band. A state where the average circularities in the respective grain size bands are not largely different from one another is important for the suppression of a void and scattering.

In addition, when the average circularity r(a) of the toner each having a circle-equivalent diameter of 2.00 μm or more to less than 3.00 μm and the average circularity R of the toner each having a circle-equivalent diameter of 2.00 μm or more satisfy the relationship of r(a)>R+0.015, high mobility can be obtained, but a cleaning failure such as the escape of fine particulate toner from a cleaning blade is apt to occur. Further, toner packing is apt to occur in a toner container or a developing unit, so an image failure resulting from the formation of an aggregate tends to occur, or the uniformity of a solid image tends to deteriorate. Accordingly, the relationship is not preferable. In addition, in a system where transfer residual toner is recovered simultaneously with development, recovering property upon development becomes insufficient. As a result, toner that cannot be completely recovered rotates on a photosensitive drum in association with the rotation of the drum, so fog may occur.

In addition, when the average circularity r(a) of the toner each having a circle-equivalent diameter of 2.00 μm or more to less than 3.00 μm and the average circularity R of the toner each having a circle-equivalent diameter of 2.00 μm or more satisfy the relationship of r(a)<R−0.015, the circularity of a particle having a fine particle diameter becomes such that the particle is amorphous. As a result, an area of contact between the toner and a carrier or any other member increases, so toner liberation is inhibited. In this case, the toner is apt to reside in a developing unit without being developed, so the continuous use of the toner may cause carrier spent or the contamination of members such as a sleeve.

In addition, when the average circularity r(c) of the toner each having a circle-equivalent diameter of 6.92 μm or more to less than 12.66 μm and the average circularity R of the toner each having a circle-equivalent diameter of 2.00 μm or more satisfy the relationship of r(c)>R+0.015, the circularity of toner having a coarse particle diameter becomes relatively high. Such toner having a relatively large particle diameter and a high circularity is apt to scatter from a developing unit because an adhesive force between the toner and an electrophotographic photosensitive member or a transfer member is low. In addition, an adhesive force between toner also weakens. As a result, when a recording medium bearing an unfixed toner image is conveyed to a fixing unit, the unfixed image is disturbed by vibration, so dot reproducibility may deteriorate.

In addition, when the average circularity r(c) of the toner each having a circle-equivalent diameter of 6.92 μm or more to less than 12.66 μm and the average circularity R of the toner each having a circle-equivalent diameter of 2.00 μm or more satisfy the relationship of r(c)<R−0.015, a large recess is present in the surface of the toner, so an added external additive does not effectively work, and mobility tends to reduce. As a result, the probability that a carrier or a sleeve and the toner contact with each other reduces, a charge amount is low, a charge amount distribution widens, and selective development occurs in some cases. In addition, an area of contact between the toner and a drum increases, and an adhesive force between them increases in some cases.

In addition, the content of the toner each having a circle-equivalent diameter of 2.00 μm or more to less than 3.00 μm in the toner each having a particle diameter corresponding to a circle-equivalent diameter of 2.00 μm or more is preferably 1.0 to 10.0 number %. The content of the toner each having a circle-equivalent diameter of 3.00 μm or more to less than 6.92 μm in the toner each having a particle diameter corresponding to a circle-equivalent diameter of 2.00 μm or more is preferably 70.0 to 90.0 number %. The content of the toner each having a circle-equivalent diameter of 6.92 μm or more to less than 12.66 μm in the toner each having a particle diameter corresponding to a circle-equivalent diameter of 2.00 μm or more is preferably 5.0 to 20.0 number %. The content of the toner each having a circle-equivalent diameter of 2.00 μm or more to less than 3.00 μm is more preferably 1.0 to 6.0 number %. The content of the toner each having a circle-equivalent diameter of 3.00 μm or more to less than 6.92 μm is more preferably 80.0 to 90.0 number %. The content of the toner each having a circle-equivalent diameter of 6.92 μm or more to less than 12.66 μm is more preferably 5.0 to 15.0 number %.

The toner has a weight average particle diameter (D4) of 3.0 to 7.0 μm, or preferably 5.0 to 6.0 μm. When the weight average particle diameter exceeds 7.0 μm, dot and line latent images cannot be faithfully developed with the toner, so the reproduction of, in particular, a photographic image or a thin line becomes poor. In addition, when the weight average particle diameter is less than 3.0 μm, it becomes difficult to control charging and toner mobility, so a stable image cannot be obtained.

In addition, a void and scattering can be favorably suppressed by making a maximum valley depth Rv (nm) of a recess in the surface of a toner particle a constant size.

The Rv (nm) can be measured by using a scanning probe microscope. Specifically, the Rv can be measured by a method to be described later.

A mean valley depth Rvm (nm) as the mean value of the Rv (nm) of the toner particles in the toner preferably satisfies the relationship of Rvm≦200, or more preferably satisfies the relationship of Rvm≦180. When the mean valley depth Rvm (nm) is set to satisfy the relationship of Rvm≦200, irregularities on the surface of a toner particle can be made uniform and fine, and the degree of aggregation Y1 at the time of compression of the toner can be easily set to satisfy the relationship of Y1≦35. As a result, adhesion between a drum or a transfer material and the toner, and adhesion between toner can be suppressed, so a void at the time of each of transfer and fixation hardly occurs. On the other hand, in the case of Rvm>200, when an inorganic fine powder is added to the surface of a toner particle, the inorganic fine powder assembles at a recess, so a projection of the toner particle is apt to be bare. In particular, when a pressure is applied to the toner in a transfer step or a fixation step, an additionally large amount of the in organic fine powder assembles at a recess, so the exposed area of the surface of the toner particle increases. Such exposure of a toner particle can be suppressed by adding a large amount of an inorganic fine powder in a production process for the toner. In this case, however, an additionally large amount of an inorganic fine powder is laminated in a recess at the same time, so adhesiveness between the inorganic fine powder on a surface side and the toner particle lowers, thereby causing various detrimental effects such as additionally remarkable spent to a carrier or to a charging roller.

In addition, the Rvm (nm) of the toner particles in the toner preferably satisfies the relationship of Rvm≧120, or more preferably satisfies the relationship of Rvm≧130. When the Rvm (nm) is set to satisfy the relationship of Rvm≧120, appropriate irregularities can be applied to the toner surface, so Y2 can be easily set to satisfy the relationship of Y2≧7. As a result, scattering at the time of development hardly occurs. On the other hand, in the case of Rvm<120, irregularities on the toner surface become flat. As a result, an inorganic fine powder effectively acts to improve mobility, so Y2 is apt to be in the relationship of Y2<7. In this case, the mobility of the toner can be reduced by reducing the addition amount of the inorganic fine powder. However, the physical properties of the toner surface largely change owing to, for example, the embedding of the inorganic fine powder in a toner particle due to long-term use, so detrimental effects such as fog due to a change in charge of the toner and a fluctuation in image density occur.

In view of the foregoing, the mean valley depth Rvm (nm) of the recesses in the toner particle surfaces is preferably set to satisfy the relationship of 120≦Rvm≦200.

The toner of the present invention has a highest endothermic peak in the temperature range of 30 to 200° C. in an endothermic curve measured with a differential scanning calorimeter (DSC), and a peak temperature Tsc (° C.) of the highest endothermic peak satisfies the relationship of 60≦Tsc≦130. A method of measuring the Tsc (° C.) will be described later.

The Tsc (° C.) of the toner of the present invention satisfies the relationship of Tsc≧60, or preferably satisfies the relationship of Tsc≧65. The Tsc (° C.) specified to have the above value can prevent the toner from solidifying at the time of compression, and can alleviate a void in a transfer step. On the other hand, in the case of Tsc<60, the hardness of the toner reduces, so the toner is apt to solidify owing to a transfer pressure. In addition, the Tsc (° C.) satisfies the relationship of Tsc≦130, preferably satisfies the relationship of Tsc≦100, or more preferably satisfies the relationship of Tsc≦85. The Tsc (° C.) specified to have the above value provides excellent mobility even at low temperature, and shows good fixability even in low-temperature, low-pressure fixation such as on-demand fixation. On the other hand, in the case of Tsc>130, the hardness of the toner becomes so high that it becomes difficult to perform sufficient fixation at low temperature and low pressure.

The range of the Tsc (° C.) of the toner can be obtained by appropriately adjusting, for example, materials for the respective components of which the toner is formed. Of such adjustments, the adjustment of the melting point of a release agent in a toner particle is effective. A release agent having a low melting point tends to have lower hardness than that of a release agent having a high melting point. Therefore, toner containing a release agent having an excessively low melting point is apt to solidify owing to a transfer pressure. When the Tsc (° C.) of the toner satisfies the relationship of Tsc<60, a void is apt to occur. On the other hand, toner containing a release agent having an excessively high melting point gets worse the exudation of the release agent at the time of fixation. Accordingly, fixability is poor when the Tsc of the toner satisfies the relationship of Tsc>130. Therefore, a release agent having as short a molecular chain as possible, showing small steric hindrance, and excellent in mobility exudes better, and toner containing such release agent is excellent in fixability.

A release agent to be added to the toner is not particularly limited as long as the release agent is suitable for satisfying the requirements of the physical properties of the toner of the present invention. Examples of the release agent include: aliphatic hydrocarbon-based waxes such as a low-molecular-weight polyethylene, a low-molecular-weight polypropylene, an olefin copolymer, a microcrystalline wax, a paraffin wax, and a Fischer-Tropsch wax; oxides of aliphatic hydrocarbon-based waxes such as an oxidized polyethylene wax; block copolymers of aliphatic hydrocarbon-based waxes; waxes each mainly composed of a fatty acid ester such as a carnauba wax, behenyl behenate, and a montanate wax; and release agents each obtained by partially or entirely deoxidizing a fatty acid ester such as a deoxidized carnauba wax.

The examples further include: partially esterified products of aliphatic acids and polyhydric alcohols such as behenic acid monoglyceride; and methyl ester compounds obtained by hydrogenating vegetable fats and oils and each having a hydroxyl group. An aliphatic hydrocarbon-based wax having a short molecular chain, showing small steric hindrance, and excellent in mobility such as a paraffin wax, polyethylene, or a Fischer-Tropsch wax is a wax to be particularly preferably used.

The molecular weight distribution of the release agent is such that a main peak is present in a molecular weight region of preferably 350 to 2,400, or more preferably 400 to 2,000. Toner containing a release agent having such molecular weight distribution has preferable heat characteristics. The addition amount of the release agent is preferably 1 to 20 parts by mass, or more preferably 2 to 15 parts by mass with respect to 100 parts by mass of a binder resin.

In addition, a dispersed liquid prepared by dispersing the toner in a 45-vol % aqueous solution of methanol has a transmittance (%) for light having a wavelength of 600 nm in the range of preferably 30 to 70%, or more preferably 35 to 50%.

In the measurement of the transmittance, the toner is forcibly dispersed in a mixed solvent once in order that a characteristic of each of the toner particles may easily appear. A predetermined time period after that, the transmittance for light is measured. Therefore, the tendency of the state of presence of the release agent in the entire toner in which the state of presence of the release agent in each toner particle is reflected can be accurately grasped. In addition, when a large amount of the release agent, which is hydrophobic, is present on the toner surface, the toner is hardly dispersed in the mixed solvent, so the toner floats on the surface of the mixed solvent, or the aggregated toner precipitates. As a result, the transmittance has a high value. In contrast, when the abundance of the release agent on the toner surface is small, the amount of a binder resin, which is hydrophilic, increases, so the toner can be easily dispersed in the mixed solvent with improved uniformity, and the transmittance has a low value.

In toner having the above transmittance of 30 to 70%, the release agent is appropriately exposed to the surface of a toner particle. Such toner enables fixation under a light load, and can suppress the occurrence of a void. In addition, such toner can: achieve a wide fixation region; prevent the desorption of a release agent component from the toner; and suppress contamination to a developing member even in long-term use.

A binder resin to be incorporated into a toner particle is not particularly limited as long as the binder resin is suitable for satisfying the physical properties of the toner of the present invention, and known binder resins can be used in combination. The use of a resin containing a polyester unit among those resins is effective for obtaining toner excellent in low-temperature fixability and rise up of charging. The use of a resin containing a vinyl-based polymer unit that improves the dispersibility of the release agent is also effective for imparting uniform chargeability. Accordingly, the binder resin to be used in the toner of the present invention is preferably a resin selected from (a) a polyester resin, (b) a hybrid resin having a polyester unit and a vinyl-based polymer unit, (c) a mixture of a hybrid resin and a vinyl-based polymer, (d) a mixture of a polyester resin and a vinyl-based polymer, (e) a mixture of a hybrid resin and a polyester resin, and (f) a mixture of a polyester resin, a hybrid resin, and a vinyl-based polymer. Of those, one containing a hybrid resin is particularly preferably used.

It should be noted that the term "polyester unit" as used herein refers to a moiety derived from polyester, and refers to a polyester skeleton moiety in a polyester resin or in a hybrid resin. The term "vinyl-based polymer unit" as used herein refers to a moiety derived from a vinyl-based polymer, and refers to a vinyl-based polymer skeleton moiety in a vinyl-based resin or in a hybrid resin. Polyester-based monomers of which a polyester unit is constituted are a polyvalent carboxylic acid component and a polyhydric alcohol component while a vinyl-based polymer unit is a monomer component having a vinyl group.

A raw material monomers such as an alcohol and a carboxylic acid, a carboxylic anhydride, and a carboxylate can be used as polyester-based monomer constituting a polyester unit. Specific examples of a dihydric alcohol component include: bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A.

Examples of a trihydric or higher alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene and so on.

Examples of a carboxylic acid component include: aromatic dicarboxylic acids such as phthalic acid, isophthalic acid, and terephthalic acid, or anhydrides thereof; alkyldicarboxylic acids such as succinic acid, adipic acid, sebacic acid, and azelaic acid, or anhydrides thereof; succinic acid substituted by an alkyl group having 6 to 12 carbon atoms, or anhydrides thereof; and unsaturated dicarboxylic acids such as fumaric acid, maleic acid, and citraconic acid, or anhydrides thereof.

It is particularly preferable that, of those, a bisphenol derivative represented by the following general formula (1) be used as a diol component, and a carboxylic acid component (such as fumaric acid, maleic acid, maleic anhydride, phthalic acid, terephthalic acid, trimellitic acid, or pyromellitic acid and so on) composed of a divalent or higher carboxylic acid, an anhydride thereof, or a lower alkylester thereof be used as an acid component because a polyester resin obtained by polycondensation of those components has excellent charging property for toner.

[Chem 1]

Formula (1)

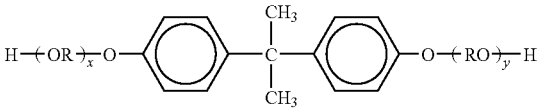

(In the formula, R represents an ethylene group or a propylene group, x and y each represent an integer of one or more, and x+y has an average value of 2 to 10.)

Examples of a trivalent or higher carboxylic acid component (polyvalent carboxylic acid component) for forming a polyester resin with a crosslinking site include 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides and ester compounds thereof. The amount of the trivalent or higher carboxylic acid component to be used is preferably 0.1 to 1.9 mol % on the basis of a total of monomers.

Further, when a hybrid resin having a polyester unit and a vinyl-based polymer unit is used as a binder resin, additionally good dispersibility of the release agent, and improvements in low-temperature fixability and offset resistance can be expected. The "hybrid resin component" to be used in the present invention refers to a resin in which a vinyl-based polymer unit and a polyester unit are chemically bonded to each other. An example of the resin is one in which a polyester unit and a vinyl-based polymer unit polymerized by using a monomer having a carboxylate group such as an acrylate are bonded to each other by an ester exchange reaction. The resin is preferably a graft copolymer (or a block copolymer) using a vinyl-based polymer as a stem polymer and a polyester unit as a branch polymer.

Examples of a vinyl-based monomer for forming a vinyl-based polymer unit include: styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethylmethacrylate, propylmethacrylate, n-butyl methacrylate, isobutyl methacrylate, n-octyl methacrylate, dodecyl methacrylate, 2-ethylhexyl methacrylate, stearylmethacrylate, phenylmethacrylate, dimethylaminoethylmethacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methylether, vinyl ethylether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylic acid or methacrylic acid derivatives such as acrylonitrile, methacrylonitrile, and acrylamide.

The examples further include monomers each having a carboxyl group such as: unsaturated dibasic acids such as maleic acid, citraconic acid, itaconic acid, alkenylsuccinic acid, fumaric acid, and mesaconic acid; unsaturated dibasic anhydrides such as maleic anhydride, citraconic anhydride, itaconic anhydride, and alkenylsuccinic anhydrides; half esters of unsaturated dibasic acids such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride; anhydrides of the α,β-unsaturated acids with lower fatty acids; and alkenylmalonic acid, alkenylglutaric acid, alkenyladipic acid, acid anhydrides thereof, and monoesters thereof.

The examples still further include monomers each having a hydroxy group such as: acrylates or methacrylates such as 2-hydroxyethyl acrylate, 2-hydroxyethyl methacrylate, and 2-hydroxypropyl methacrylate; and 4-(1-hydroxy-1-methylbutyl)styrene and 4-(1-hydroxy-1-methylhexyl)styrene.

In addition, a vinyl-based polymer unit in a binder resin may be crosslinked with a crosslinking agent having 2 or more vinyl groups to have a crosslinking structure. Examples of a cross linking agent used in this case include: aromatic divinyl compounds such as divinylbenzene and divinylnaphthalene; diacrylate compounds linked with an alkyl chain such as ethylene glycol diacrylate, 1,3-butylene glycol diacrylate, 1,4-butanediol diacrylate, 1,5-pentanedioldiacrylate, 1,6-hexanediol diacrylate, and neopentyl glycol diacrylate, and the above compounds whose acrylate moiety has been replaced with methacrylate; diacrylate compounds linked with an alkyl chain containing an ether linkage such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate, and the above compounds whose acrylate moiety has been replaced with methacrylate; and diacrylate compounds linked with a chain containing an aromatic group and an ether linkage such as polyoxyethylene(2)-2,2-bis(4-hydroxyphenyl)propane diacrylate and polyoxyethylene(4)-2,2-bis(4-hydroxyphenyl)propane diacrylate, and the above compounds whose acrylate moiety has been replaced with methacrylate.

Examples of a polyfunctional crosslinking agent include: pentaerythritol triacrylate, trimethylolethane triacrylate, trimethylolpropane triacrylate, tetramethylolmethane tetraacrylate, and oligoester acrylate, and the above compounds whose acrylate moiety has been replaced with methacrylate; triallylcyanurate; and triallyltrimellitate.

The binder resin has a main peak in a molecular weight region of 3,500 to 30,000, or preferably 5,000 to 20,000 in a molecular weight distribution measured by means of gel permeation chromatography (GPC), and preferably has a ratio Mw/Mn of 5.0 or more. When the main peak of the binder resin is present in a molecular weight region of less than 3,500, the hot offset resistance of the toner is apt to be insufficient. On the other hand, when the main peak is present in a molecular weight region in excess of 30,000, the toner cannot obtain sufficient low-temperature fixability, with the result that it becomes difficult to apply the toner to high-speed fixation. In addition, when the ratio Mw/Mn is less than 5.0, it becomes difficult to obtain good offset resistance.

In addition, the binder resin has a glass transition temperature (Tg) of preferably 40 to 90° C., or more preferably 45 to 85° C. Further, the resin has an acid value of preferably 1 to 40 mgKOH/g.

Examples of a polymerization initiator to be used in producing the vinyl-based polymer unit to be used in the binder resin include: 2,2'-azobisisobutyronitrile; 2,2'-azobis(4-methoxy-2,4-dimethylvaleronitrile); 2,2'-azobis(2,4-dimethylvaleronitrile); 2,2'-azobis(2-methylbutyronitrile); dimethyl-2,2'-azobisisobutyrate; 1,1'-azobis(1-cyclohexanecarbonitrile); 2-(carbamoylazo)-isobutyronitrile; 2,2'-azobis(2,4,4-trimethylpentane); 2-phenylazo-2,4-dimethyl-4-methoxyvaleronitrile; 2,2'-azobis(2-methyl-propane); ketone peroxides such as methyl ethyl ketone peroxide, acetylacetone peroxide, and cyclohexanone peroxide; 2,2-bis(t-butylperoxy)butane; t-butyl hydroperoxide; cumene hydroperoxide; 1,1,3,3-tetramethylbutyl hydroperoxide; di-t-butyl peroxide; t-butylcumyl peroxide; dicumyl peroxide; α,α'-bis(t-butylperoxyisopropyl)benzene; isobutyl peroxide; octanoyl peroxide; decanoyl peroxide; lauroyl peroxide; 3,5,5-trimethylhexanoyl peroxide; benzoyl peroxide; m-toluoyl peroxide; di-isopropyl peroxydicarbonate; di-2-ethylhexylperoxydicarbonate; di-n-propyl peroxydicarbonate; di-2-ethoxyethyl peroxycarbonate; di-methoxyisopropyl peroxydicarbonate; di(3-methyl-3-methoxybutyl) peroxycarbonate; acetylcyclohexylsulfonyl peroxide; t-butyl peroxyacetate; t-butyl peroxyisobutyrate; t-butyl peroxyneodecanoate; t-butyl peroxy-2-ethylhexanoate; t-butylperoxylaurate; t-butylperoxybenzoate; t-butyl peroxyisopropylcarbonate; di-t-butyl peroxyisophthalate; t-butyl peroxyallylcarbonate; t-amylperoxy-2-ethylhexanoate; di-t-butyl peroxyhexahydroterephthalate, and di-t-butyl peroxyazelate.

Examples of a method of synthesizing a hybrid resin to be used in the toner of the present invention include the production methods shown in the following items (1) to (5).

(1) The hybrid resin can be synthesized by: producing each of a vinyl-based polymer, a polyester resin, and a hybrid resin component; dissolving and swelling them in an organic solvent (such as xylene) adding an esterification catalyst and an alcohol to the resultant; and heating the resultant to perform an ester exchange reaction.

(2) A method of synthesizing a hybrid resin involves: producing a vinyl-based polymer unit; and allowing a polyester unit and/or a hybrid resin component to react in the presence of the vinyl-based polymer unit.

(3) A method of synthesizing a hybrid resin involves: producing a polyester unit; and allowing a vinyl-based polymer unit and/or a hybrid resin component to react in the presence of the polyester unit.

(4) A method of synthesizing a hybrid resin involves: producing a vinyl-based polymer unit and a polyester unit; and allowing a vinyl-based monomer and/or a polyester monomer (such as an alcohol or a carboxylic acid) to react in the presence of those polymer units.

(5) A method of synthesizing a hybrid resin involves: mixing a vinyl-based monomer and a polyester monomer (such as an alcohol or a carboxylic acid); and continuously subjecting the mixture to an addition polymerization reaction and a condensation polymerization reaction.

In each of the production methods described in the above items (1) to (5), the vinyl-based polymer unit and/or the polyester unit can employ not only units which are the same in molecular weight and in degree of crosslinking but also multiple polymer units different from each other in molecular weight and in degree of crosslinking.

A colorant is not particularly limited as long as the colorant satisfies the conditions for the physical properties of the toner of the present invention, and any one of the known pigments and dyes can be used alone, or two or more of them can be used in combination. Examples of the colorant include the following.

Examples of a magenta coloring pigment include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, and 238; C.I. Pigment Violet 19; and C.I. Vat Red 1, 2, 10, 13, 15, 23, 29, and 35 and so on.

Examples of a cyan coloring pigment include: C.I. Pigment Blue 2, 3, 15, 15:1, 15:2, 15:3, 16, and 17; C.I. Acid Blue 6; C.I. Acid Blue 45; and copper phthalocyanine pigments each having a phthalocyanine skeleton substituted by 1 to 5 phthalimidomethyl groups and so on.

Examples of a yellow coloring pigment include: C.I. Pigment Yellow 1, 2, 3, 4, 5, 6, 7, 10, 11, 12, 13, 14, 15, 16, 17, 23, 65, 73, 74, 83, 93, 97, 155, 180, and 185; and C.I. Vat Yellow 1, 3, and 20 and so on.

Examples of a black pigment include carbon black such as furnace black, channel black, acetylene black, thermal black, and lamp black and soon. Magnetic powder such as magnetite or ferrite may also be used. Further, one having a black tone obtained by using the yellow/magenta/cyan/black colorants described above may be used.

The content of the colorant is preferably 1 to 15 parts by mass, more preferably 3 to 12 parts by mass, or still more preferably 4 to 10 parts by mass with respect to 100 parts by mass of the binder resin. When the content of the colorant is larger than 15 parts by mass, transparency reduces. In addition, the reproducibility of a halftone typified by a human skin color is apt to reduce. Further, the stability of chargeability of toner reduces, and low-temperature fixability is hardly obtained. When the content of the colorant is smaller than 1 part by mass, coloring power reduces, so an increased amount of toner must be used to achieve a desired density, and low-temperature fixability may be poor.

An inorganic fine powder to be incorporated into the toner is not particularly limited as long as the addition of the powder to classified toner particles can improve mobility as compared to that before the addition. For example, all of: a fluorine-based resin powder such as a vinylidene fluoride fine powder or a polytetrafluoroethylene fine powder; a titanium oxide fine powder; an alumina fine powder; fine powdered silica such as silica obtained through a wet process or silica obtained through a dry process; and one obtained by treating the surface of any one of the above powders with a silane coupling agent, a titanium coupling agent, silicone oil, or the like can be used.

Silica obtained through a dry process is, for example, a fine powder produced through the gas phase oxidation of a silicon halide compound, so called dry process silica or fumed silica. The dry process silica or fumed silica is produced by a conventionally known technique. For example, the production utilizes a thermal decomposition oxidation reaction in the oxyhydrogen flame of a silicon tetrachloride gas, and a basic reaction formula for the reaction is represented by the following formula:

$$SiCl_4+2H_2+O_2 \rightarrow SiO_2+4HCl.$$

A composite fine powder of silica and any other metal oxide can also be obtained by using the silicon halide compound with any other metal halide compound such as aluminum chloride or titanium chloride in the production step, and the dry process silica comprehends the composite fine powder as well. A silica fine powder having an average primary particle diameter in the range of 0.001 to 2 μm is desirably used.

Further, it is more preferable to use a treated silica fine powder obtained by subjecting a silica fine powder produced through the vapor phase oxidation of the silicon halide compound to a hydrophobic treatment.

A silica fine powder is chemically treated with an organic silicon compound that reacts with or physically adsorbs to the silica fine powder, or the like, whereby hydrophobicity is imparted to the silica fine powder. A preferable method involves treating a silica fine powder produced through the gas phase oxidation of a silicon halide compound with an organic silicon compound.

The above-mentioned dry process silica treated with a coupling agent having an amino group or with silicone oil may be used as an inorganic fine powder as required for achieving an object of the present invention. The inorganic fine powder to be used in the present invention is desirably used in an amount of 0.01 to 8 parts by mass with respect to 100 parts by mass of the toner particles.

As described above, any one of various inorganic fine powders can be used in the present invention. Of those, a fine powder the surface of which is treated with silicone oil is preferably used, and a silica fine powder such as silica obtained through a dry process the surface of which is treated with silicone oil is more preferably used. The reason for the foregoing is as follows: a treatment with silicone oil improves the ability of the toner to hold charge, so the toner hardly dissipates charge, and hence a change in charge due to a state where the toner is left can be suppressed.

In addition, it is preferable that: the above inorganic fine powder contain at least an inorganic fine powder (A) having a number average particle diameter of 20 nm or more to less than 300 nm and an inorganic fine powder (B) having a number average particle diameter of 5 nm or more to less than 20 nm; and the surface of at least one of the inorganic fine powder (A) and the inorganic fine powder (B) be treated with silicone oil.

The number average particle diameter of the inorganic fine powder (A), which is 20 nm or more and less than 300 nm, is more preferably 20 nm or more and less than 150 nm. When the number average particle diameter of the inorganic fine powder (A) is 20 nm or more and less than 300 nm, even if image output is continued over a long time period, the inorganic fine powder (A) is not embedded in a colored particle, so the toner and a drum do not contact with each other at the surface of the colored particle, and a state of point contact between an inorganic fine particle and the drum can be maintained. In addition, releasability between the toner and the drum is maintained. As a result, a reduction in transfer efficiency can be suppressed. When the number average particle diameter is less than 20 nm, the action of the inorganic fine powder as a spacer weakens, with the result that the contribution of the powder to an improvement in transferability reduces. On the other hand, when the number average particle diameter exceeds 300 nm, the inorganic fine powder is apt to desorb from a colored particle, so it becomes difficult to cause the powder to adhere to the surface of the colored particle stably, and transfer efficiency is apt to reduce. In addition, the inorganic fine powder desorbs from the toner at the time of development to contaminate the periphery of a developing unit, or the desorbed fine powder adheres to a photosensitive drum, a carrier, or the like, with the result that a reduction in charging performance occurs in some cases.

In addition, the number average particle diameter of the inorganic fine powder (B) is preferably 5 nm or more and less than 20 nm. When the number average particle diameter of the inorganic fine powder (B) is less than 5 nm, the inorganic fine powder (B) is apt to be embedded in the toner surface owing to long-term image output, so the physical adhesive force of mobile toner increases, and mobility reduces in some cases. On the other hand, when the number average particle diameter is larger than 20 nm, an effect of imparting mobility reduces, so charging property tends to be unstable.

In addition, the inorganic fine powder (B) is more preferably treated with silicone oil. A treatment with silicone oil can prevent the occurrence of a so-called "transfer void" in which the central portion of a line of a line image or letter image on an image is not transferred and only an edge portion of the line is transferred. The absence of a treatment with silicone oil may cause the "transfer void".

Examples of an inorganic compound that can be used as the above in organic fine powder (A) include silica, alumina, and titanium oxide and so on. In addition, in the case of silica, any silica produced by employing a conventionally known technique such as a vapor phase decomposition method, a combustion method, or a deflagration method can be used; silica produced by a sol-gel method is particularly preferable. The sol-gel method is a method involving: performing the hydrolysis and condensation reaction of an alkoxysilane in an organic solvent in which water is present with the aid of a catalyst to prepare a silica sol suspension; removing the solvent from the suspension; drying the remainder; and turning the resultant into particles.

Further, the surface of silica obtained through the sol-gel method may be subjected to a hydrophobic treatment, and a silane compound is preferably used as a hydrophobic treatment agent. Examples of the silane compound include: monochlorosilanes such as hexamethyldisilazane, trimethylchlorosilane, and triethylchlorosilane; monoalkoxysilanes such as trimethylmethoxysilane and trimethylethoxysilane; monoaminosilanes such as trimethylsilyldimethylamine and trimethylsilyldiethylamine; and monoacyloxysilanes such as trimethylacetoxysilane.

The above inorganic fine powder (B) is preferably an inorganic fine powder different from the inorganic fine powder (A) in composition. A state where the powders are different from each other in composition refers to a state where they are different from each other in constitution. For example, they may be different from each other in material, or they may be different from each other in surface treatment or shape even when they are identical to each other in material.

Specific examples of a material for the inorganic fine powder (B) include: various metal compounds (such as aluminum oxide, titanium oxide, strontium titanate, cerium oxide, magnesium oxide, chromium oxide, tin oxide, and zinc oxide); nitrides (such as silicon nitride); carbides (such as silicon carbide); metal salts (such as calcium sulfate, barium sulfate, and calcium carbonate); aliphatic metal salts (such as zinc stearate and calcium stearate); carbon black; and silica and so on. A silica fine particle treated with silicone oil is particularly preferable. In addition, the silica fine particle may be subjected to a combination of the treatment with silicone oil and a surface treatment with, for example, a silane compound, an organic silicon compound, or a titanium coupling agent. The external addition of a silica fine particle treated with silicone oil to the toner can impart good mobility and good chargeability to the toner.

In addition, the ratio at which the surfaces of the toner particles are covered with an inorganic fine powder (coverage factor) is preferably 60% or more. When the coverage factor of the inorganic fine powder (A) is represented by F(A) and the coverage factor of the inorganic fine powder (B) is represented by F(B), F(A) and F(B) more preferably satisfy a relationship represented by an expression (8):

$$1.0 \leqq F(B)/F(A) \leqq 10.0 \qquad \text{Ex. (8).}$$

Here, a coverage factor F of an individual inorganic fine powder can be determined from the following expression (9):

$$F=(3^{1/2}\times D4\times \rho t)/(2\pi\times da\times \rho a)\times C \qquad \text{Ex. (9)}$$

where D4 represents the weight average particle diameter of the toner, ρt represents the specific gravity of the toner, da represents the number average particle diameter of the inorganic fine powder, ρa represents the specific gravity of the inorganic fine powder, and C represents the addition amount of the inorganic fine powder with respect to 100 parts by mass of the toner particles.

When the coverage factor of the inorganic fine powder with respect to the surfaces of the toner particles is 60% or more and the expression (8) is satisfied, the transfer void of a line image or the like is suppressed, there by enabling good transfer. When the ratio F(B)/F(A) is smaller than 1.0, steric hindrance resulting from the size of the inorganic fine powder (A) occurs, so an effect of the addition of the inorganic fine powder (B) is inhibited, and it becomes difficult to obtain an effect of the addition of a combination of different in organic fine powders sufficiently. In addition, when the ratio F(B)/F(A) is larger than 10.0, the releasability of the toner from a peripheral member reduces, so a desired effect exerted by the combined use of different inorganic fine powders cannot be sufficiently obtained. It should be noted that the ratio F(B)/F(A) is more preferably 1.0 to 5.0.

The addition amount of the above inorganic fine powder (A) is preferably 0.3 to 5.0 parts by mass, or more preferably 0.5 to 3.0 parts by mass with respect to 100 parts by mass of the toner particles.

The addition amount of the above inorganic fine powder (B) is preferably 0.1 to 5.0 parts by mass, or more preferably 0.5 to 2.5 parts by mass with respect to 100 parts by mass of the toner particles.

The toner preferably contains the inorganic fine powder (A), the inorganic fine powder (B) and one or more kinds of inorganic fine powders selected from titanium oxide and aluminum oxide which are different from the inorganic fine powder (A) and the inorganic fine powder (B) in BET or crystal form.

The incorporation of one or more kinds of inorganic fine powders selected from titanium oxide or aluminum oxide in addition to the inorganic fine powder (A) and the inorganic fine powder (B) is preferable in terms of improvements in mobility and chargeability. An improvement in mobility enables the toner to be sufficiently charged by stirring in a developing unit, whereby the toner becomes effective against fog and toner scattering. In general, when toner is left under a high-temperature, high-humidity environment, there arises the following problem: an absolute charge amount reduces, and, after the output of the final image, a state where no image is outputted continues for a long time period, so a required image density is hardly obtained when an image is outputted after a lapse of a long time period from the output of the final image. The external addition of such inorganic fine powders can alleviate the problem because the external addition exerts additionally significant effects on fog and toner scattering.

In addition, examples of an external additive that can be used in addition to the inorganic fine powders described above include: various inorganic oxide fine particles, and fine particles obtained by subjecting the inorganic oxide fine particles to a hydrophobic treatment as required; a vinyl-based polymer; zinc stearate; and resin fine particles. The addition amount of any one of those external additives is preferably in the range of 0.02 to 5 mass % with respect to the total mass of the toner particles.

In addition, the toner may further be added with a charge control agent. Examples of the charge control agent include organometallic complexes, metal salts, and chelate compounds such as monoazo metal complexes, acetylacetone metal complexes, hydroxycarboxylic acid metal complexes, polycarboxylic acid metal complexes, and polyol metal complexes. In addition, the examples include: carboxylic acid derivatives such as carboxylic acid metal salts, carboxylic anhydrides, and carboxylates; and condensates of aromatic compounds. Any one of phenol derivatives such as bisphenols and calixarenes may also be used as the charge control agent. Each of aromatic carboxylic acid metal compounds may preferably be used in view of rise up of charging. It is desirable that the addition amount of the charge control agent to be used in the toner of the present invention be 0.2 to 10 parts by mass, or preferably 0.3 to 7 parts by mass with respect to 100 parts by mass of the binder resin. This is because an addition amount of less than 0.2 part by mass hardly exerts a sufficient improving effect on rise up of charging and an addition amount in excess of 10 parts by mass shows a tendency of the toner to fluctuate largely with an environment.

The toner of the present invention, which can be suitably used in a non-magnetic, one-component developer, is preferably used in a two-component developer. In this case, the toner is mixed with a magnetic carrier before use.

Examples of a magnetic carrier that can be used include: particles of metals such as iron, lithium, calcium, magnesium, nickel, copper, zinc, cobalt, manganese, chromium, and a rare earth metal each having an oxidized or unoxidized surface; and the alloy particles, oxide particles, and ferrites of the metals. In addition, a known magnetic carrier such as a resin carrier produced by mixing any one of those metals with a resin can be used without any particular limitation. A coated carrier obtained by coating the surfaces of the above magnetic carrier particles with a resin is particularly preferable in a development method involving applying an alternating bias to a developing sleeve. Examples of an applicable coating method include conventionally known methods such as: a method involving dissolving or suspending a coating material such as a resin in a solvent to prepare an application liquid and causing the liquid to adhere to the surface of a magnetic carrier core particle; and a method involving mixing a magnetic carrier core particle and a coating material each in powder form.

Examples of a material with which the surface of a magnetic carrier core particle is coated include a silicone resin, a polyester resin, a styrene-based resin, an acrylic resin, polyamide, polyvinyl butyral, and an amino acrylate resin. Any one of them may be used alone, or two or more of them may be used together. The amount of the above coating material with which the carrier core particles are treated is preferably 0.1 to 30 mass % (or more preferably 0.5 to 20 mass %) with respect to the carrier core particles. Those carrier have an average particle diameter of 10 to 100 μm, or preferably 20 to 70 μm.

When a two-component developer is prepared by mixing the toner of the present invention and a magnetic carrier, a good result can be typically obtained when a mixing ratio between them is such that a toner concentration in the developer is 2 to 15 mass %, or preferably 4 to 13 mass %. A toner concentration of less than 2 mass % is apt to reduce an image density while a toner concentration in excess of 15 mass % is apt to cause fog or scattering in a machine.

Next, a method of producing the toner will be described. The toner of the present invention can be obtained by using any one of various approaches. For example, the uniformization of fine irregularities on the toner surface based on a fresh look at a pulverization step in toner production is effective for obtaining toner having a degree of aggregation specified in the present application. In addition, as described in JP-A-2004-295100, a method for increasing a circularity while preventing a large amount of a release agent from being present on the surface is also effective. It should be noted that the present invention is not limited to one produced by the production method.

In order that the toner of the present invention may be obtained, a pulverization step preferably includes a step of performing pulverization in multiple stages near a desired grain size instead of obtaining the desired grain size in one stroke. This is because the presence of such step enables one to utilize the power of a pulverizing device as not only pulverization energy but also energy for uniformizing irregularities on the surface of a toner particle. In addition, the pulverization step preferably further includes a step of performing classification simultaneously with spheroidization.

Hereinafter, specific description of the toner production method will be made. First, in a raw material mixing step, predetermined amounts of at least a binder resin, a releasing agent, and a colorant, and further a charge control agent if necessary as toner internal additives are weighed and mixed. Examples of a mixing device include a double cone mixer, a V-type mixer, a drum type mixer, a super mixer, a Henschel mixer, and a Nauta mixer and do on.

Further, the toner raw materials mixed in the above step are melted and kneaded, and the colorant and the like are dispersed in the resins to obtain a colored resin composition. In the melting and kneading, a batch type kneader such as a pressure kneader or a Banbury mixer, or a continuous kneader can be used. In recent years, a uniaxial or biaxial extruder has gone mainstream because of its superiority such as the ability of continuous production. Examples of a uniaxial or biaxial extruder generally used include a KTK type biaxial extruder manufactured by Kobe Steel, Ltd., a TEM type biaxial extruder manufactured by Toshiba Machine Co., Ltd, a biaxial extruder manufactured by KCK, and a Ko-kneader manufactured by Bus. A colored resin composition obtained by melting and kneading the toner raw materials is rolled by means of a two-roll mill or the like after the melting and kneading, and is cooled by water cooling or the like.

Next, the cooled product of the colored resin composition is pulverized in order that toner particles may be obtained. In general, the above cooled product is merely pulverized into particles each having a desired particle diameter. However, in order that the toner of the present invention may be obtained, the pulverization step preferably includes a step of controlling fine irregularities on a toner particle to increase a circularity. In a coarse pulverization step to be performed first, in general, raw materials for the toner particles are coarsely pulverized into pieces each having a size of about 1 to 3 mm. However, in order that the toner of the present invention may be obtained, the coarse pulverization step is preferably repeated until coarsely pulverized products each having a size of about 0.3 mm are obtained. A crusher, a hammer mill, a feather mill, or the like can be used in the coarse pulverization step. Next, the coarsely pulverized products are intermediately pulverized into intermediately pulverized products each having a size slightly larger than a desired toner particle diameter (for example, about 6 μm) by using a Kryptron system manufactured by Kawasaki Heavy Industries, a Super rotor manufactured by Nisshin Engineering Inc., a Turbo mill manufactured by Turbo Kogyo Co., Ltd., or the like. After that, further, the intermediately pulverized products are finely pulverized into finely pulverized products each having the desired toner particle diameter (for example, about 5 μm) by using a Turbo mill (RSS rotor/SNNB liner) manufactured by Turbo Kogyo Co., Ltd. Unlike a conventional Turbo mill, a Turbo mill equipped with an RSS rotor/an SNNB liner has a distance between cog and cog of a rotor as short as 70% of that of a general Turbo mill, and has a height of cog as low as 70% of that of the general Turbo mill. As a result, the time period for which a pulverized product is present between a cog and another cog is expected to be short, and the time period for which the pulverized product resides between the rotor and the liner is expected to be long. The long residence time contributes to the uniformization of fine irregularities, whereby toner having such degree of aggregation as specified in the present application and an even circularity distribution may be easily obtained. In addition, the fact that the pulverization step consists of multiple stages is also expected to contribute largely to the uniformization of irregularities on the surface of a toner particle.

Further, a treatment with a device that performs classification simultaneously with spheroidization is also effective for additionally uniformizing irregularities on the surfaces of the finely pulverized products obtained as described above. The device can provide toner particles each having a desired toner grain size while increasing a circularity, and a specific example of the device is a Faculty manufactured by Hosokawa Micron Corporation. The performance of the toner production as described above can easily provide toner particles capable of realizing the toner physical properties of the present invention.

Toner can be obtained by: blending predetermined amounts of the toner particles thus obtained and an inorganic fine powder; and stirring and mixing the resultant by using a high-speed stirring machine that applies a shear force to a powder such as a Henschel mixer or a Super mixer as an external addition machine. When a silica fine powder, a titanium oxide fine powder, and an alumina fine powder are used in combination as the inorganic fine powder, the following procedure is preferably adopted: the titanium oxide fine powder, the alumina fine powder, and the like each having a low resistance are mixed in advance by using the high-speed stirring machine as an external addition machine, and then the silica fine powder is additionally mixed with the mixture.

After the inorganic fine powder has been added and mixed as described above, a coarse powder produced at the time of external addition may be removed by using a screen classifier such as a HIBOLTA (manufactured by Shin Tokyo Kikai KK) as an air screen as required.

Figure 4:
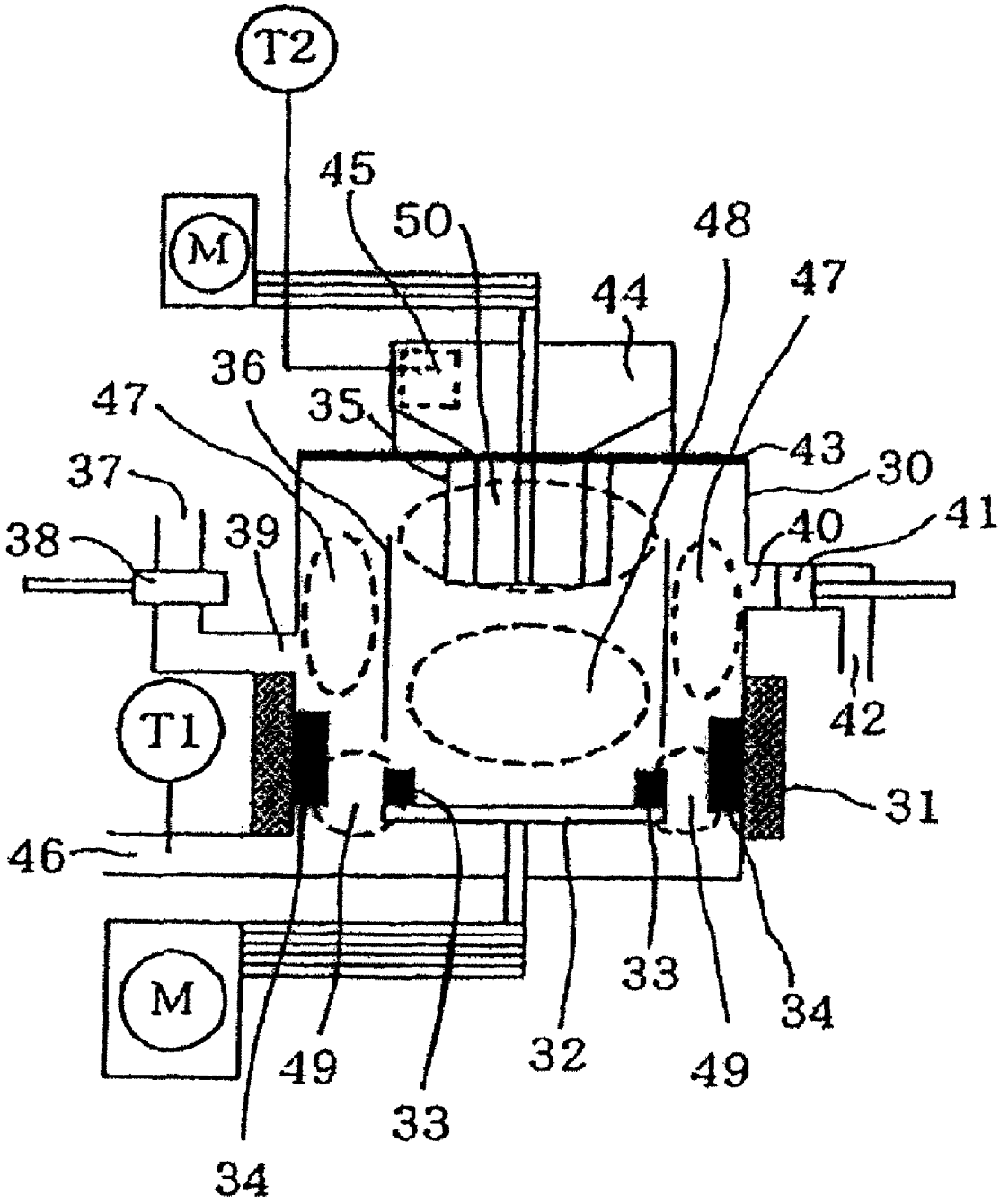
FIG. 4 is an outline sectional view showing an example of a surface modification apparatus.

FIG. 4 shows an example of an apparatus capable of performing classification and spheroidization simultaneously.

A batch type surface modification apparatus shown in FIG. 4 includes: a cylindrical main body casing 30; a top plate 43 installed on the upper portion of the main body casing so as to be openable and closable; a fine powder discharge portion 44 having a fine powder discharge casing and a fine powder discharge pipe; a cooling jacket 31 through which cooling water or antifreeze can pass; a dispersion rotor 32 as spheroidizing means, the dispersion rotor 32 being present in the main body casing 30 and attached to the central rotation axis of the casing, the dispersion rotor 32 having multiple square disks 33 on its upper surface, and the dispersion rotor 32 being a disk-like rotator that rotates in a predetermined direction at a high speed; a liner 34 fixedly placed on the periphery of the dispersion rotor 32 with a predetermined interval between them, the liner 34 being provided with many grooves on its surface opposed to the dispersion rotor 32; a classification rotor 35 for continuously removing a fine powder and an ultra-fine powder each having a particle diameter equal to or smaller than a predetermined particle diameter in finely pulverized products; a cold air introduction port 46 for introducing cold air into the main body casing 30; an input pipe formed on the side surface of the main body casing 30 for introducing the finely pulverized products (raw material) and having raw material input port 37 and raw material supply port 39; products discharge pipe having products discharge port 40 and products extraction port 42 for discharging treated toner particles to the outside of the main body casing 30; an openable and closable raw material supply valve 38 installed between the raw material input port 37 and the raw material supply port 39 in order that a treatment time may be freely adjusted; and products discharge valve 41 installed between the products discharge port 40 and the products extraction port 42.

The batch type surface modification apparatus has, in the main body casing 30, a cylindrical guide ring 36 as guiding means having an axis perpendicular to the top plate 43. The guide ring 36 is provided so that its upper end is distant from the top plate by a predetermined distance. The guide ring is fixed to the main body casing 30 by a support so as to cover at least part of the classification rotor 35. The lower end of the guide ring 36 is provided so as to be distant from each of the square disks 33 of the dispersion rotor 32 by a predetermined distance.

In the batch type surface modification apparatus, a space between the classification rotor 35 and the dispersion rotor 32 is divided by the guide ring 36 into two spaces: a first space 47 outside the guide ring 36 and a second space 48 inside the guide ring 36. The first space 47 is a space for introducing the finely pulverized product and particles subjected to a surface modification treatment into the classification rotor 35. The second space is a space for introducing the finely pulverized product and the particles subjected to a surface modification treatment into the dispersion rotor. A gap portion between each of the multiple square disks 33 installed on the dispersion rotor 32 and the liner 34 constitutes a surface modification zone 49. The classification rotor 35 and the peripheral portion of the classification rotor 35 constitute a classification zone 50.

Next, an image forming method of the present invention will be described.

The image forming method of the present invention is an image forming method including: a charging step of charging an image bearing member; a latent image formation step of forming an electrostatic latent image on the image bearing member charged in the charging step; a development step of developing the electrostatic latent image formed on the image bearing member with toner to form a toner image; a transfer step of transferring the toner image on the image bearing member onto a transfer material through an intermediate transfer member; and a fixation step of fixing the toner image to the transfer material by bringing the toner image into press contact with the transfer material at a fixation nip portion formed between a fixing member and a pressurizing member, and is characterized in that: a contact pressure at the fixation nip portion is 5.0 to 11.0 $N/m^2$; and the toner of the present invention is used as the above toner. The contact pressure is lower than a pressure to be generally adopted, and can effectively draw a function of the toner of the present invention.

The contact pressure can be determined by dividing a force applied between the fixing member and the pressurizing member by a nip area calculated as the product of a nip width and the longitudinal length of a roller.

An image forming apparatus employing a general cleaning mode in which the toner of the present invention and a developer can be used will be described.

Figure 2:
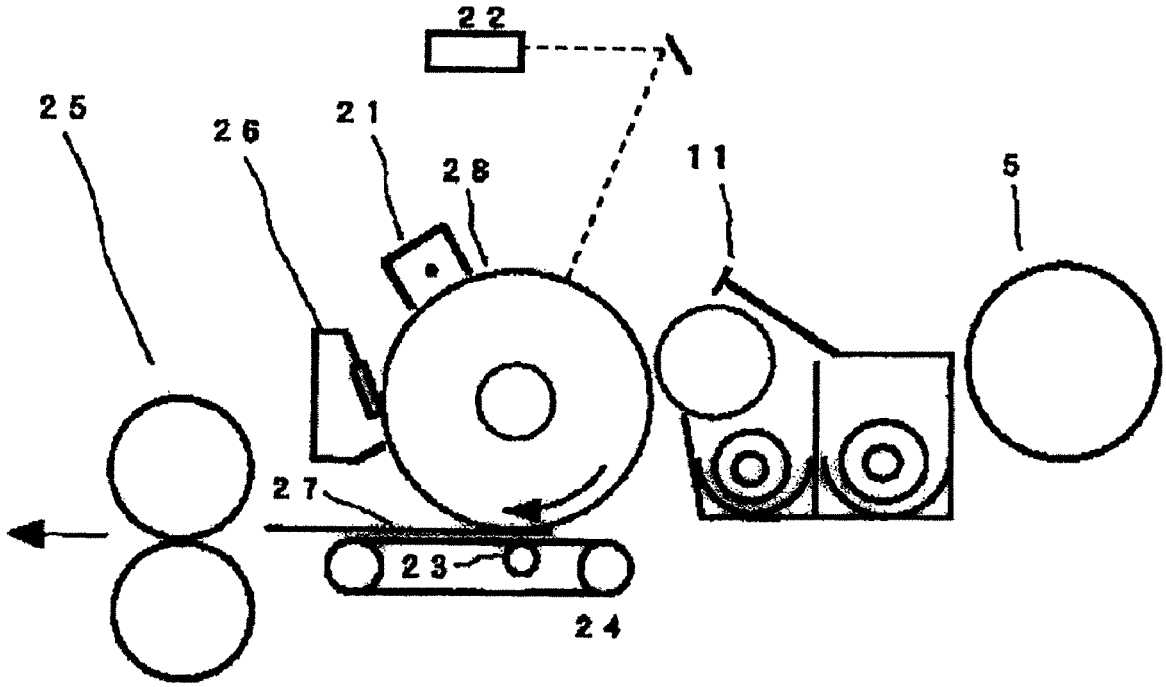
FIG. 2 is a schematic sectional view showing an image forming apparatus employing a cleaning mode.

FIG. 2 is a schematic sectional view showing an image forming apparatus employing a typical cleaning mode. In FIG. 2, first, the surface of an image bearing member (such as an electrophotographic photosensitive drum) 28 uniformly charged by a charging unit 21 as charging means is exposed to light by a laser exposing unit 22 as latent image forming means, whereby an electrostatic latent image is formed on the image bearing member 28. After that, the electrostatic latent image on the image bearing member 28 is visualized (developed) as a toner image by a developing device 11 as developing means.

The toner image is transferred by a transfer electric field generated by a transfer charging unit 23 onto recording paper 27 as a recording medium conveyed by a transfer belt 24. After that, the recording paper 27 is peeled off from the transfer belt 24. Then, the transferred image is pressurized and heated by a fixing unit 25, whereby a fixed image can be obtained.

In addition, the residual toner and carrier remaining on the image bearing member 28 after the transfer are removed by a cleaner (cleaning device) 26 so that the apparatus is ready for the next image formation. The cleaner 26 has a blade abutting with the image bearing member 28 over an image formation region and a non-image formation region on the member. The cleaner 26 is constituted so as to rub and remove even a carrier electrostatically dislocated from a developer carrier (such as a developing sleeve) to the non-image formation region on the image bearing member 28 against a magnetic force.

In addition, the toner of the present invention is more preferably applied to, in particular, an image forming method including a system that recovers transfer residual toner in a development step because a charge failure or the like resulting from a void that is apt to occur particularly in the system can be eliminated.

Figure 3:
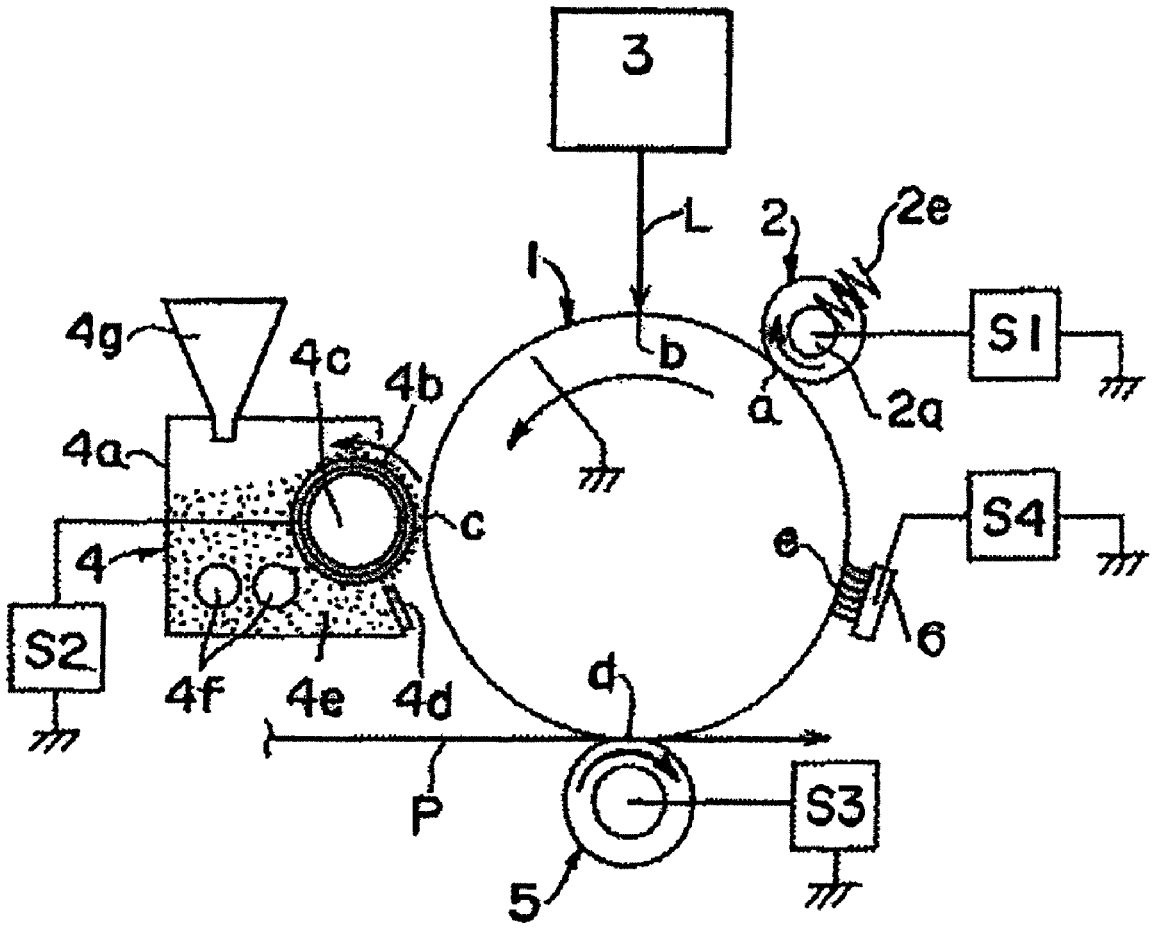
FIG. 3 is a schematic sectional view showing an image forming apparatus including a development and cleaning step.

FIG. 3 shows a system that recovers transfer residual toner simultaneously with development. In FIG. 3, an electrophotographic photosensitive member 1 as an image bearing member rotates in a "b" direction. The photosensitive member 1 is charged by a charging device 2 as charging means. After that, laser light L is incident from an exposing device 3 as electrostatic latent image forming means on the charged surface of the photosensitive member 1, whereby an electrostatic latent image is formed. Next, the electrostatic latent image is visualized as a toner image by a developing device 4 as developing means, and is transferred onto a transfer material P by a transferring device 5 as transferring means. Transfer residual toner remaining on the surface of the photosensitive member without being transferred by the transferring means is used again in development or recovered by the developing device through the charging means and the electrostatic latent image forming means described above.

In addition, as shown in FIG. 3, smoothing means 6 connected with bias applying means is preferably provided. Causing the transfer residual toner to pass through the smoothing means 6 can improve: the uniformity of the charge polarity of the transfer residual toner; and the recovery rate of the transfer residual toner.

Methods of measuring various physical properties will be described.

1) Measurement of Degree of Aggregation of Toner

The degree of aggregation Y2 at the time of non-compression is determined from the following expression (1) by: weighing about 1 g of the toner; leaving the toner under a normal-temperature, normal-humidity environment (23° C./60% RH) for 12 hours or longer; vibrating the toner by using a Powder Tester (manufactured by Hosokawa Micron Corporation) at an amplitude of 1 mm for 1 minute; and measuring the ratio of the toner remaining on each mesh. A mesh having an aperture of 250 μm, a mesh having an aperture of 150 μm, and a mesh having an aperture of 75 μm, which are used in the measurement, are arranged in the stated order from an upper portion. It should be noted that, upon measurement of the degree of aggregation at the time of non-compression, weighing and the like are performed in such a manner that the toner sample receives as low a pressure as possible.

Degree of aggregation=(Ratio(mass %)of toner remaining on 250-μm screen)+(Ratio(mass %)of toner remaining on 150-μm screen)×0.6+(Ratio (mass %)of toner remaining on 75-μm screen)× 0.2(1)

The degree of aggregation Y1 at the time of compression is determined as described below. About 1 g of the toner is weighed. The toner is left under a normal-temperature, normal-humidity environment (23° C./60% RH) for 12 hours or longer. After that, the toner is loaded into a flat molding unit having a diameter of 25 mm in such a manner that the toner becomes flat. The molding unit is capped with a flat lid, and a load of 200 kPa is applied for 1 minute. After that, the load is removed, and the toner is transferred to powder paper in such a manner that the toner is prevented from collapsing to the extent possible. Then, the degree of aggregation is measured by using a Powder Tester in the same manner as that described above.

2) Measurement of Highest Endothermic Peak of Toner

Temperature Curve:

Temperature Increase I (30° C. to 200° C., rate of temperature increase 10° C./min)

Temperature Decrease I (200° C. to 30° C., rate of temperature decrease 10° C./min)

Temperature Increase II (30° C. to 200° C., rate of temperature increase 10° C./min)

The highest endothermic peak of the toner is measured by using a differential scanning calorimeter (DSC measuring device), a DSC-7 (manufactured by PerkinElmer Co., Ltd.), or a DSC 2920 (manufactured by TA Instruments Japan Inc.) in conformity with ASTMD 3418-82. It should be noted that, in this example, the measurement was performed by using a DSC-7.

5 to 20 mg, preferably 10 mg, of a measurement sample are precisely weighed. The sample is loaded into an aluminum pan. In addition, an empty aluminum pan is used as a reference. Measurement is performed in the measurement range of 30 to 200° C. at a rate of temperature increase of 10° C./min under a normal-temperature, normal-humidity environment (23° C./60% RH). The highest endothermic peak of the toner is a peak having the highest height from a base line in a temperature region of the Tg of the measurement sample in the course of Temperature Increase II. When an endothermic peak at Tg and another endothermic peak overlap with each other so that it is difficult to judge a highest endothermic peak, a peak having the highest height from the base line among the endothermic peaks including the overlapping endothermic peak is defined as the highest endothermic peak.

3) Measurement of Molecular Weight of Release Agent

Device: GPC-150 C (Waters Corporation)

Column: GMH-HT30 cm, a series of two columns (manufactured by TOSOH CORPORATION)

Temperature: 135° C.

Solvent: o-dichlorobenzene (added with 0.1 mass % of ionol)

Flow rate: 1.0 ml/min

Sample: 0.4 ml of a 0.15-mass % release agent is injected.

Measurement is performed under the above conditions. Upon calculation of the molecular weight of the release agent, a molecular weight calibration curve prepared by using monodisperse polystyrene standard samples is used. Examples of usable polystyrene standard samples for preparing an analytical curve include samples each having a molecular weight of about $10^2$ to $10^7$. At least about ten polystyrene standard samples are suitably used. Examples of samples that can be used include TSK standard polystyrenes manufactured by TOSOH CORPORATION (F-850, F-450, F-288, F-128, F-80, F-40, F-20, F-10, F-4, F-2, F-1, A-5000, A-2500, A-1000, and A-500). Further, the molecular weight of the release agent is calculated by polyethylene conversion on the basis of a conversion equation derived from Mark-Houwink's viscosity equation.

4) Measurement of Average Circularity of Toner

The circularity of the toner is calculated by using the following expression after measurement with a flow-type particle image measuring device "FPIA-2100" (manufactured by Sysmex Corporation).

Circularity=(Circumferential length of a circle having the same area as a particle projected area)/(Circumferential length of the particle projected image) (Equation 1)

The term "particle projected area" is defined as an area of a binarized particle image, while the term "circumferential length of the particle projected image" is defined as the length of a borderline obtained by connecting the edge points of the particle image. The measurement is performed by using a particle image that has been subjected to image processing at an image processing resolution of 512×512 (a pixel measuring 0.3 μm×0.3 μm).

The circularity in the present invention is an indication of the degree of irregularities on a particle. The circularity is 1.00 when the particle has a completely spherical shape. The more complicated the surface shape, the lower the circularity.

In addition, the average circularity C which means the average value of a circularity frequency distribution is calculated from the following expression when the circularity (central value) of a divisional point i in a particle size distribution is denoted by ci and the number of measured particles is denoted by m.

$$\text{Average circularity } C = C = \sum_{i=1}^{m} (c_i / m) \quad \text{(Equation 2)}$$

The measuring device "FPIA-2100", which is used in measurement of average circularity or the like of toner in the present invention, calculates the average circularity by: calculating the circularities of the respective particles; classifying the particles into classes, which are obtained by equally dividing the circularity range of 0.40 to 1.00 at an interval of 0.01 (ranges: 0.40 or more to less than 0.41; 0.41 or more to less than 0.42; . . . ; 0.98 or more to less than 0.99; 0.99 or more to less than 1.00; and 1.00), depending on the resultant circularities; and calculating the average circularity by using the central value of each divisional point of each class and the number of the particles classified into each class.

A specific measurement method for average circularity using FPIA-2100 is as follows. 10 ml of ion-exchanged water from which an impurity solid and the like have been removed in advance are prepared in a vessel. An appropriate amount of a surfactant, preferably sodium dodecylbenzenesulfonate is added to the ion-exchanged water as a dispersant and 0.02 g of the toner is further added there to and uniformly dispersed in the mixture. The resultant mixture is subjected to a dispersion treatment for 2 minutes by using an ultrasonic dispersing unit "Tetora 150" (manufactured by Nikkaki-Bios Co., Ltd.) as dispersion means to prepare dispersed liquid for measurement. At that time, the dispersed liquid is appropriately cooled in order that the temperature of the dispersed liquid may not be 40° C. or higher.

Prior to the initiation of measurement, automatic focusing is performed by using standard latex particles (for example, 5200A manufactured by Duke Scientific diluted with ion-exchanged water). In addition, in order that a circularity variation may be suppressed, the temperature of an environment where a flow-type particle image analyzer FPIA-2100 is installed is controlled to 23° C.±0.5° C. so that the temperature in the analyzer becomes 26 to 27° C. Further, automatic focusing is performed by using standard latex particles (for example, 5200A manufactured by Duke Scientific diluted with ion-exchanged water) every 2 hours. It should be noted that, in each example of the present application, a flow-type particle image analyzer which had been subjected to a calibration operation by Sysmex Corporation, and which had received a calibration certificate issued by Sysmex Corporation was used, and the measurement was performed under measurement and analysis conditions identical to those at the time of the reception of the calibration certificate except that particle diameters to be analyzed were limited to ones each corresponding to a circle-equivalent diameter of 2.00 μm or more to 200.00 μm or less.

At the time of the measurement, the concentration of the dispersed liquid is adjusted in such a manner that the concentration of the toner and the toner particles becomes 3,000 to 10,000 particles/μl. The circularities and circle-equivalent diameters of 1,000 or more particles are measured. After the measurement, the average circularity of the toner is determined by using the data while data on particles each having a circle-equivalent diameter of less than 2.00 μm is discarded.

It should be noted that a circle-equivalent diameter can be calculated on the basis of the following expression.

Circle-equivalent diameter= (Particle projected area/$\pi$)$^{1/2}$×2 (Equation 3)

An average circularity in the circle-equivalent diameter range of 2.00 μm or more to less than 3.00 μm, an average circularity in the circle-equivalent diameter range of 3.00 μm or more to less than 6.92 μm, and an average circularity in the circle-equivalent diameter range of 6.92 μm or more to less than 12.66 μm are each calculated from the above expression on the basis of data on the circularities of particles in each circle-equivalent diameter range.

Further, the measuring device "FPIA-2100" used in the present invention has an increased magnification of a processed particle image and an increased processing resolution of a captured image (256×256→512×512) as compared to a measuring device "FPIA-1000" which has been conventionally used for calculating the shapes of toner and toner particles. Therefore, the measuring device "FPIA-2100" has increased accuracy of shape measurement. As a result, the measuring device "FPIA-2100" has achieved additionally accurate capture of a fine particle. Therefore, in the case where a shape must be measured additionally accurately as in the case of the present invention, the FPIA-2100 that can furnish additionally accurate information about the shape is more useful.

5) Measurement of Mean Valley Depth of Toner Particle Surfaces

In the present invention, the maximum valley depth Rv (nm) in a toner particle surface is measured by using a scanning probe microscope. An example of a measurement method is shown below.

Probe station: SPI 3800N (manufactured by Seiko Instruments Inc.)

Measuring unit: SPA 400

Measurement mode: DFM (resonance mode) shape image

Cantilever: SI-DF 40P

Resolution: Number of pieces of X data 256

Number of pieces of Y data 128

In the present invention, a 2-μm square area on a toner particle surface is measured. A 2-μm square area at the central portion of a toner particle surface to be measured with a scanning probe microscope is defined as an area to be measured. A particle (D4±10%) having a size substantially equal to a weight average particle diameter (D4) measured by a Coulter Counter method is selected at random as a toner particle to be measured, and the maximum valley depth Rv in the surface of the toner particle is measured. The measured data is subjected to second order correction. 20 or more different toner particles are measured, and the resultant pieces of data on Rv are averaged and defined as the mean valley depth Rvm of the toner particle surfaces.

When the Rv in a toner particle surface in toner containing toner particles each externally added with an external additive is measured by using a scanning probe microscope, the external additive must be removed, and a specific example of a method of removing the external additive involves the following items:

(1) 45 mg of the toner are loaded into a sample bottle, and 10 ml of methanol are added;

(2) the sample is dispersed with an ultrasonic cleaner for 1 minute so that the external additive is separated;

(3) the resultant is subjected to suction filtration (with a 10-μm membrane filter) so that the toner particles and the external additive are separated provided that, in the case of toner containing a magnetic material, only a supernatant may be separated by attaching a magnet to the bottom of the sample bottle to fix the toner particles; and (4) the above items (2) and (3) are each repeated 3 times in total, and the resultant particles are sufficiently dried by using a vacuum dryer at room temperature.

The toner particles from each of which the external additive has been removed are observed with a scanning electron microscope. After the disappearance of the external additive has been confirmed, the mean valley depth of the toner particles is measured with a scanning probe microscope. When the external additive is not sufficiently removed, the above items (2) and (3) are repeated until the external additive is sufficiently removed. Then, the surfaces of the toner particles are observed with a scanning probe microscope. Another method of removing the external additive which replaces the above items (2) and (3) is, for example, a method involving dissolving the external additive in an alkali. The alkali is preferably an aqueous solution of sodium hydroxide.

6) Measurement of Molecular Weight Distribution of Each of Toner and Binder Resin by Means of GPC A molecular weight distribution in each of the toner and the resin component of the binder resin is measured by using a THF soluble component, which is obtained by dissolving the toner or the binder resin in a THF solvent, by means of GPC as described below.

That is, the toner is loaded into THF, and the whole is left for several hours. After that, the resultant is sufficiently shaken, and is mixed with THF well (until the coalesced body of the sample disappears). Then, the resultant is left standing for an additional 12 hours or longer. In this case, the time period for which the toner is left in THF is set to 24 hours or longer. After that, the resultant is passed through a sample treatment filter (having a pore size of 0.45 to 0.5 μm, for example, a Myshori Disc H-25-5 manufactured by TOSOH CORPORATION or an Ekicrodisc 25CR manufactured by German Science Japan Co., Ltd. can be used), and is regarded as a sample for GPC. In addition, a sample concentration is adjusted in such a manner that the concentration of the resin component is 0.5 to 5 mg/ml.

The sample prepared by the above method is measured by means of GPC as described below. A column is stabilized in a heat chamber at 40° C. Tetrahydrofuran (THF) as a solvent is allowed to flow into the column having the temperature at a flow rate of 1 ml/min. About 50 to 200 μl of the resultant solution of the sample in THF are injected for measurement. Upon measurement of the molecular weight of the sample, the molecular weight distribution possessed by the sample is calculated from a relationship between a logarithmic value of an analytical curve prepared by using several kinds of monodisperse polystyrene standard samples and the number of counts (retention time). Examples of usable standard polystyrene samples for preparing an analytical curve include samples manufactured by TOSOH CORPORATION or by Pressure Chemical Co. having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. At least about ten standard polystyrene samples are suitably used. A refractive index (RI) detector is used as a detector.

It is recommended that a combination of multiple commercially available polystyrene gel columns be used as the column in order that a molecular weight region of $1\times10^3$ to $2\times10^6$ may be accurately measured. Examples of the combination include: a combination of shodex GPC KF-801, 802, 803, 804, 805, 806, and 807 manufactured by Showa Denko K.K.; and a combination of μ-styragel 500, $10^3$, $10^4$, and $10^5$ manufactured by Waters Corporation.

7) Measurement of Grain Size Distribution and Weight Average Particle Diameter (D4) of Toner In the present invention, the average particle diameter and grain size distribution of the toner are measured by using a Coulter Counter TA-II (manufactured by Beckman Coulter, Inc), but can be measured by using a Coulter Multisizer (manufactured by Beckman Coulter, Inc). An electrolyte solution is a 1% aqueous solution of NaCl prepared by using reagent grade sodium chloride. For example, an ISOTON R-II (manufactured by Coulter Scientific Japan, Co.) can be used as an electrolyte solution. A measurement method is as described below. 100 to 150 ml of the electrolyte aqueous solution are added with 0.1 to 5 ml of a surfactant, preferably sodium dodecylbenzenesulfonate, as a dispersant. Further, 2 to 20 mg of a measurement sample are added to the mixture. The electrolyte solution in which the sample has been suspended is subjected to a dispersion treatment by using an ultrasonic dispersing unit for about 1 to 3 minutes. The volumes and number of toner each having a size of 2.00 μm or more are measured by using the measuring device with the aide of a 100-μm aperture as an aperture, and a volume distribution and a number distribution are calculated. The weight average particle diameter (D4) is determined from the distributions (the central value of each channel is defined as a representative value for the channel).

The channels to be used consist of 13 channels: a channel having a particle diameter range of 2.00 to 2.52 μm, a channel having a particle diameter range of 2.52 to 3.17 μm, a channel having a particle diameter range of 3.17 to 4.00 μm, a channel having a particle diameter range of 4.00 to 5.04 μm, a channel having a particle diameter range of 5.04 to 6.35 μm, a channel having a particle diameter range of 6.35 to 8.00 μm, a channel having a particle diameter range of 8.00 to 10.08 μm, a channel having a particle diameter range of 10.08 to 12.70 μm, a channel having a particle diameter range of 12.70 to 16.00 μm, a channel having a particle diameter range of 16.00 to 20.20 μm, a channel having a particle diameter range of 20.20 to 25.40 μm, a channel having a particle diameter range of 25.40 to 32.00 μm, and a channel having a particle diameter range of 32.00 to 40.30 μm.

8) Measurement of Softening Point (Tm) of Resin

The term "softening point" refers to one measured with a Koka type flow tester in conformity with JIS K 7210. A specific measurement method is shown below. While 1 $cm^3$ of a sample is heated by using a Koka type flow tester (manufactured by Shimadzu Corporation) at a rate of temperature increase of 6° C./min, a load of 1,960 $N/m^2$ (20 $kg/cm^2$) is applied to the sample by using a plunger so that a nozzle having a diameter of 1 mm and a length of 1 mm is extruded. A plunger fall out amount (flow value)-temperature curve is drawn on the basis of the result of the extrusion. The height of the S-shaped curve is represented by h, and the temperature corresponding to h/2 (the temperature at which one half of a resin flows out) is defined as the softening point (Tm) of the resin.

9) Measurement of Number Average Particle Diameter of Inorganic Fine Powder

The number average particle diameter of the inorganic fine powder is measured by using a scanning electron microscope (S-4700 manufactured by Hitachi, Ltd.). The powder is photographed at a magnification of 100,000, and, further, the photographed picture is extended by a factor of 2. After that, 200 to 500 samples of the inorganic fine powder are sampled from the photographic image at random. Then, a maximum particle diameter is defined as a longer diameter, a minimum particle diameter is defined as a shorter diameter, and a number average particle diameter is determined with reference to the longer diameter. In the case where the number average particle diameter of the inorganic fine powder on the toner particle surfaces is measured, elemental analysis is performed in advance with an energy dispersive X-ray analyzer (manufactured by EDAX) upon sampling; sampling is performed after the kind and shape of each particle have been grasped.

10) Measurement of Transmittance in 45-Vol % Aqueous Solution of Methanol (i) Preparation of Toner-Dispersed Liquid An aqueous solution containing a mixture of methanol and water at a volume ratio of 45:55 is prepared. 10 ml of the aqueous solution are charged into a 30-ml sample bottle (NICHIDEN-RIKA GLASS Co., Ltd.: SV-30), and 20 mg of the toner are immersed in the liquid surface, followed by the capping of the bottle. After that, the bottle is shaken with a Yayoi shaker (model: YS-LD) at 2.5 $S^{-1}$ for 5 seconds. In this case, the angle at which the bottle is shaken is set as described below. A direction right above the shaker (vertical direction) is set to 0°, and a shaking support is adapted to move forward by 15° and backward by 20°. The sample bottle is fixed to a fixing holder (prepared by fixing the lid of the sample bottle onto an extended line from the center of the support) attached to the tip of the support. A dispersed liquid 30 seconds after the sample bottle has been taken is provided as a dispersed liquid for measurement.

(ii) Transmittance Measurement

The dispersed liquid prepared in the above item (i) is charged into a 1-cm square quartz cell. A transmittance (%) for light having a wavelength of 600 nm in the dispersed liquid 10 minutes after the charging is measured by using a spectrophotometer MPS 2000 (manufactured by Shimadzu Corporation).

Transmittance (%)=$(I/I_0)\times 100$ (I: Transmitted luminous flux, $I_0$: Incident luminous flux)

EXAMPLES

Hereinafter, the present invention will be described by way of specific examples. However, the present invention is not limited to these examples.

Production Example of Hybrid Resin

Placed in to a dropping funnel were 2.0 mol of styrene, 0.21 mol of 2-ethylhexyl acrylate, 0.14 mol of fumaric acid, 0.03 mol of a dimer of α-methylstyrene, and 0.05 mol of dicumyl peroxide as monomers for forming a vinyl-based polymer unit. Placed in a 4-L four-necked flask made of glass were 7.0 mol of polyoxypropylene(2.2)-2,2-bis(4-hydroxyphenyl) propane, 3.0 mol of polyoxyethylene(2.2)-2,2-bis(4-hydroxyphenyl)propane, 3.0 mol of terephthalic acid, 1.9 mol of trimellitic anhydride, 5.0 mol of fumaric acid, and 0.2 g of dibutyltin oxide as monomers for forming a polyester resin unit. A thermo meter, a stirring bar, a condenser, and a nitrogen introducing pipe were installed on the four-necked flask, and the flask was placed in a mantle heater. Subsequently, air in the flask was substituted by nitrogen gas, and the flask was gradually heated while the mixture in the flask was stirred. Then, the monomers for a vinyl-based resin and a polymerization initiator were dropped from the dropping funnel over 4 hours to the flask while the mixture in the flask was stirred at 145° C. Next, the mixture in the flask was heated to 200° C., and was reacted for 4 hours to yield a hybrid resin (Tm=110° C.). Table 1 shows the molecular weight measurements by GPC.

Production Example of Polyester Resin

Placed in a 4-L four-necked flask made of glass were 3.6 mol of polyoxypropylene(2.2)-2,2-bis(4-hydroxyphenyl) propane, 1.6 mol of polyoxyethylene(2.2)-2,2-bis(4-hydroxyphenyl)propane, 1.7 mol of terephthalic acid, 0.1 mol of trimellitic anhydride, 2.4 mol of fumaric acid, and 0.12 g of dibutyltin oxide. A thermometer, a stirring bar, a condenser, and a nitrogen introducing pipe were installed on the four-necked flask, and the flask was placed in a mantle heater. The mixture in the flask was reacted for 5 hours at 215° C. in a nitrogen atmosphere to yield a polyester resin (Tm=95° C.). Table 1 shows the molecular weight measurements by GPC.

TABLE 1

| | molecular weight measurements | | | |
|---|---|---|---|---|
| | Weight average molecular weight Mw | Number average molecular weight Mn | Main peak molecular weight Mp | Mw/Mn |
| Hybrid resin | 82000 | 3200 | 15500 | 25.6 |
| Polyester resin | 22100 | 2900 | 6000 | 7.6 |

Example 1

Toner 1 was produced as described below.

| | |
|---|---|
| Hybrid resin described above | 60 parts by mass |
| Cyan pigment (Pigment Blue 15:3) | 40 parts by mass |

Melting and kneading were performed by using a kneader mixer according to the above formulation, whereby a cyan master batch was produced.

| | |
|---|---|
| Hybrid resin described above | 91 parts by mass |
| Purified normal paraffin (highest endothermic peak temperature 70° C., Mw = 450, Mn = 320) | 5 parts by mass |
| Cyan master batch described above (having a coloring matter content of 40 mass %) | 15 parts by mass |

Preliminary mixing was sufficiently performed by using a Henschel mixer according to the above formulation. The resultant was melted and kneaded by using a biaxial extrusion kneader in such a manner that the temperature of a kneaded product would be 150° C. After having been cooled, the kneaded product was coarsely pulverized into pieces each having a size of about 1 to 2 mm by using a hammer mill. Then, the pieces were pulverized again by using the hammer mill with its hammer shape changed and its mesh fined down, whereby coarsely pulverized products each having a size of about 0.3 mm were produced. Further, the coarsely pulverized products were pulverized into intermediately pulverized products each having a size of about 11 μm by using a Turbo mill (RS rotor/SNB liner) manufactured by Turbo Kogyo Co., Ltd. Further, the intermediately pulverized products were pulverized into intermediately pulverized products each having a size of about 6 μm by using a Turbo mill (RSS rotor/SNNB liner) manufactured by Turbo Kogyo Co., Ltd. The intermediately pulverized products were treated again under the same condition (RSS rotor/SNNB liner), whereby finely pulverized products each having a size of about 5 μm were produced. It should be noted that pulverization with a Turbo mill was performed at a number of revolutions of 7,400 rpm while cold air having a temperature of −20° C. was introduced into the device. Next, the finely pulverized products were turned into particles each having a particle diameter of 5.3 μm by performing spheroidization simultaneously with classification with a Faculty manufactured by Hosokawa Micron Corporation in which the height of a disk installed on the surface of a dispersion rotor had been increased by a factor of 1.5, whereby cyan particles 1 (toner particles) were obtained.

First, 0.9 part by mass of an anatase type titanium oxide fine powder (BET specific surface area=80 $m^2/g$, treated with 12 mass % of isobutyltrimethoxysilane) was externally added to 100 parts by mass of the above cyan particles 1 (toner particles) by using a Henschel mixer. Further, 1.2 parts by mass of oil-treated silica (inorganic fine powder B; number average particle diameter 12 nm, BET specific surface area 95 $m^2/g$, treated with 15 mass % of dimethyl silicone oil) and 0.3 part by mass of oil-treated silica (in organic fine powder A; number average particle diameter 30 nm, BET specific surface area 28 $m^2/g$, treated with 5 mass % of dimethyl silicone oil) were externally added to the mixture by using a Henschel mixer, whereby Toner 1 was prepared. Toner 1 had a weight average particle diameter (D4) of 5.3 μm. Tables 2 and 3 show the physical properties of Toner 1.

Further, Toner 1 and magnetic ferrite carrier particles (volume average particle diameter 40 μm: Mn—Mg ferrite) each having a surface coated with a silicone resin were mixed in such a manner that a toner concentration would be 8.0 mass %, whereby a two-component developer 1 was obtained.

The two-component developer 1 was subjected to a 1,000-sheet printing durability test for an original manuscript having an image area ratio of 5% by using an LBP-5900 (manufactured by Canon Inc.) in a monochromatic mode under a normal-temperature, low-humidity environment (23° C./5% RH). It should be noted that the LBP-5900 was a device having an intermediate transfer member, and fixation was performed with a contact pressure at a fixation nip portion set to 9.5 $N/m^2$.

Image formation using the two-component developer 1 resulted in a cyan image causing no scattering, showing no fog even after 1,000-sheet duration, and faithfully reproducing the original. In addition, fixability and blocking property were good, and the result of evaluation for a void under a high-temperature, high-humidity environment (30° C./80% RH) was also good. The evaluation criteria of the respective evaluation items are shown below, and Table 4 shows the results of evaluation.

(Fog Measurement)

A 1,000-sheet printing durability test is performed for an original manuscript having an image area ratio of 5% by using an LBP-5900 (manufactured by Canon Inc.) in a monochromatic mode under a normal-temperature, low-humidity environment (23° C./5% RH). A method of measuring fog in the durability test is as described below. First, in the case of a cyan image, the average reflectance Dr (%) of plain paper before image output is measured with a reflectometer ("REFLECTOMETER MODEL TC-6DS" manufactured by Tokyo Denshoku Co., Ltd.) mounted with an amber filter. Meanwhile, a solid white image is outputted on the plain paper, and then the reflectance Ds (%) of the solid white image is measured. Fog (Fog (%)) is determined by using those measured values from the following expression:

$$\text{Fog}(\%)=Dr(\%)-Ds(\%)$$

A: Less than 0.7%

B: 0.7% or more and less than 1.2%

C: 1.2% or more and less than 1.5%

D: 1.5% or more and less than 2.0%

E: 2.0% or more

Measurement of Fixable Region of Toner

A fixation test was performed by using a reconstructed device of a fixing unit of an LBP-5900 (manufactured by Canon Inc.) and a fixing unit the fixation temperature of which was able to be manually controlled. An unfixed image is produced by using an LBP-5900 while a development contrast is adjusted in such a manner that the amount of the toner mounted on paper is 1.2 mg/cm$^2$ in a monochromatic mode under a normal-temperature, normal-humidity environment (23° C./60% RH). An image is formed on A4 paper (EW-500 as recommended paper, manufactured by Canon Inc.) at an image area ratio of 25%. The test is performed under a normal-temperature, normal-humidity environment (23° C./60% RH) while a fixation temperature is increased from 140° C. to 215° C. in an increment of 5° C. A temperature width in which neither offset nor wrapping occurs is defined as a fixable region.

Evaluation of Toner for Blocking

About 10 g of the toner were loaded into a 100-ml polycup, and were left at 50° C. for 3 days. After that, the toner was visually evaluated. The evaluation criteria are described below.

A: No aggregation is observed.

B: An aggregation is slightly observed, but can be easily collapsed.

C: An aggregation is observed, but can be easily collapsed.

D: An aggregation is observed, but can be collapsed by shaking.

E: An aggregation can be grasped, and cannot be easily collapsed.

Evaluation of Toner for Void

A development contrast is adjusted in such a manner that the amount of the toner mounted on paper is 0.6 mg/cm$^2$ in a monochromatic mode under a high-temperature, high-humidity environment (30° C./80% RH) by an LBP-5900 (manufactured by Canon Inc.). An image is formed in such a manner that thin lines are present in both longitudinal and transverse directions. Two lines of 2-, 4-, 6-, 8-, and 10-dot line are printed in such a manner that the width of a non-latent image portion between the lines is about 1 mm. Results of visual observation and observation with a loupe having a magnification of 20 were used as the criteria of evaluation for a void.

A: Nearly no void is observed even under magnification in the 2-dot lines.

B: A void is slightly observed under magnification in the 2-dot lines, but cannot be visually observed.

C: A void is visually observed in the 2-dot lines, but no void is visually observed in the 4-dot lines.

D: A void is visually observed in the 4-dot lines, but no void is visually observed in the 6-dot lines.

E: A void is visually observed in the 6-dot lines.

Evaluation of Toner for Scattering

A transverse line pattern image obtained by printing 4-dot transverse lines every 176 dot spaces by using an LBP-5900 (manufactured by Canon Inc.) in a monochromatic mode under a normal-temperature, low-humidity environment (23° C./5% RH) was evaluated for scattering. Observation under magnification was performed by using a loupe having a magnification of 20.

A: Nearly no image scattering is observed even under magnification.

B: Only slight image scattering is observed even under magnification.

C: A letter is slightly blurred by scattering.

D: The thickness of a line becomes uneven owing to scattering.

E: Part of fine letters are observed to collapse owing to scattering.

Example 2

Cyan particles 2 (toner particles) were obtained in the same manner as in Example 1 except that: the hybrid resin in Example 1 was changed to the above polyester resin; and the purified paraffin (highest endothermic peak temperature 70° C., Mw=450, Mn=320) in Example 1 was changed to a polyethylene wax (highest endothermic peak temperature 99° C., Mw=770, Mn=620) as shown in Table 2. After that, external addition was performed in the same manner as in Example 1, whereby Toner 2 having physical properties shown in Tables 2 and 3 was obtained. The toner was evaluated for each of various items in the same manner as in Example 1. As a result, as shown in Table 4, the toner was slightly poor in fixability, but showed good results.

Example 3

Cyan particles 3 (toner particles) were obtained in the same manner as in Example 2 except that: the polyethylene wax (highest endothermic peak temperature 99° C., Mw=770, Mn=620) in Example 2 was changed to a polyethylene wax (highest endothermic peak temperature 126° C., Mw=2,560, Mn=1,920) as shown in Table 2; and the temperature of the cold air to be introduced into the Turbo mill was changed to 0° C. After that, external addition was performed in the same manner as in Example 1, whereby Toner 3 having physical properties shown in Tables 2 and 3 was obtained. The toner was evaluated for each of various items in the same manner as in Example 1. As a result, as shown in Table 4, the toner was poor in scattering and fixability, but was at a practical level.

Example 4

Cyan particles 4 (toner particles) were obtained in the same manner as in Example 2 except that: the polyethylene wax (highest endothermic peak temperature 99° C., Mw=770, Mn=620) in Example 2 was changed to stearyl stearate (highest endothermic peak temperature 64° C., Mw=520, Mn=400) as shown in Table 2; the number of revolutions of a rotor of the Turbo mill was reduced to 6,400 rpm; and the number of revolutions of a dispersion rotor of the Faculty was reduced. After that, external addition was performed in the same manner as in Example 1, whereby Toner 4 having physical properties shown in Tables 2 and 3 was obtained. The toner was evaluated for each of various items in the same manner as in Example 1. As a result, as shown in Table 4, the toner was poor in a void, blocking, and fog, but was at a practical level.

Comparative Example 1

Finely pulverized products were produced in the same manner as in Example 2 except that the polyethylene wax (highest endothermic peak temperature 99° C., Mw=770, Mn=620) was changed to a polypropylene wax (highest endothermic peak temperature 147° C., Mw=8,900, Mn=1,000) as shown in Table 2. After that, the finely pulverized products were subjected to a heat spheroidization treatment in a Meteo Rainbow (manufactured by Nippon Pneumatic Mfg. Co., Ltd.) with hot air having a temperature of 300° C., and were classified by using an elbow jet classifier, whereby cyan particles 5 (toner particles) were obtained. After that, external addition was performed in the same manner as in Example 1, whereby Toner 5 having physical properties shown in Tables 2 and 3 was obtained. The toner was evaluated for each of various items in the same manner as in Example 1. As a result, as shown in Table 4, the toner was poor in scattering and fixability.

Comparative Example 2

Melting and kneading were performed in the same manner as in Example 2 except that the polyethylene wax (highest endothermic peak temperature 99° C., Mw=770, Mn=620) in the formulation of Example 2 was changed to palmityl palmitate (highest endothermic peak temperature 53° C., Mw=440, Mn=290) as shown in Table 2. The resultant was cooled, whereby a molten kneaded product was obtained. After that, the molten kneaded product was coarsely pulverized into pieces each having a size of about 1 to 2 mm by using a hammer mill. Then, the pieces were directly pulverized into finely pulverized products each having a size of about 5 μm by using a Turbo mill (RS rotor/SNB liner). Next, the finely pulverized products were classified by using an elbow jet classifier, whereby cyan particles 6 (toner particles) were obtained. After that, external addition was performed in the same manner as in Toner 1, whereby Toner 6 having physical properties shown in Tables 2 and 3 was obtained. The toner was evaluated for each of various items in the same manner as in Example 1. As a result, as shown in Table 4, the toner was poor in a void, blocking, and fog.

Comparative Example 3

Melting and kneading were performed according to the formulation of Example 2, and the resultant kneaded product was cooled. After that, the product was coarsely pulverized into pieces each having a size of about 1 to 2 mm by using a hammer mill. Then, the pieces were finely pulverized into pieces each having a size of about 5 μm in one stroke by using a pulverizer according to an air jet mode, whereby finely pulverized products were obtained. Next, the finely pulverized products were classified by using a Faculty manufactured by Hosokawa Micron Corporation, whereby cyan particles 7 (toner particles) were obtained. After that, external addition was performed in the same manner as in Example 1, whereby Toner 7 having physical properties shown in Tables 2 and 3 was obtained. The toner was evaluated for each of various items in the same manner as in Example 1. As a result, as shown in Table 4, the toner was poor in a void.

Comparative Example 4

| Preparation of resin particle-dispersed liquid 1 | |
|---|---|
| Styrene | 370 g |
| n-butyl acrylate | 30 g |
| Acrylic acid | 6 g |
| Dodecanethiol | 24 g |
| Carbon tetrabromide | 4 g |

The above components were mixed and dissolved to prepare a mixed liquid. The mixed liquid was dispersed and emulsified in a solution prepared by dissolving 6 g of a nonionic surfactant (Nonipol 400, manufactured by Sanyo Chemical Industries, Ltd.) and 10 g of an anionic surfactant (NEOGEN SC, manufactured by DAI-ICHI KOGYO SEIYAKU CO., LTD.) in 550 g of ion-exchanged water in a flask. While the resultant was slowly mixed for 10 minutes, 50 g of ion-exchanged water in which 4 g of ammonium persulfate had been dissolved were charged into the resultant. After replacement with nitrogen, the contents were heated in an oil bath until the temperature of the contents reached 70° C. while the inside of the flask was stirred. Then, emulsion polymerization was continued as it was for 5 hours. Thus, a resin particle-dispersed liquid 1 obtained by dispersing resin particles having an average particle diameter of 150 nm, a glass transition point of 62° C., and a weight average molecular weight (Mw) of 12,000 was prepared.

| Preparation of resin particle-dispersed liquid 2 | |
|---|---|
| Styrene | 280 g |
| n-butyl acrylate | 120 g |
| Acrylic acid | 8 g |

The above components were mixed and dissolved to prepare a mixed liquid. The mixed liquid was dispersed and emulsified in a solution prepared by dissolving 6 g of a nonionic surfactant (Nonipol 400, manufactured by Sanyo Chemical Industries, Ltd.) and 12 g of an anionic surfactant (NEOGEN SC, manufactured by DAI-ICHI KOGYO SEIYAKU CO., LTD.) in 550 g of ion-exchanged water in a flask. While the resultant was slowly mixed for 10 minutes, 50 g of ion-exchanged water in which 3 g of ammonium per sulfate had been dissolved were charged into the resultant. After replacement with nitrogen, the contents were heated in an oil bath until the temperature of the contents reached 70° C. while the inside of the flask was stirred. Then, emulsion polymerization was continued as it was for 5 hours. Thus, a resin particle-dispersed liquid 2 obtained by dispersing resin particles having an average particle diameter of 110 nm, a glass transition point of 55° C., and a weight average molecular weight (Mw) of 550,000 was prepared.

| Preparation of release agent particle-dispersed liquid 1 | |
|---|---|
| Polyethylene wax (having a melting point of 89° C.) | 50 g |
| Anionic surfactant (NEOGEN SC, manufactured by DAI-ICHI KOGYO SEIYAKU CO., LTD.) | 5 g |
| Ion-exchanged water | 200 g |

The above components were heated to 95° C., and then were dispersed by using a homogenizer or the like. After that, the resultant was subjected to a dispersion treatment with a pressure ejection type homogenizer, whereby a release agent particle-dispersed liquid 1 obtained by dispersing a release agent having an average particle diameter of 570 nm was prepared.

| Preparation of colorant particle-dispersed liquid 1 | |
|---|---|
| C.I. Pigment Blue 15:3 | 20 g |
| Anionic surfactant (NEOGEN SC, manufactured by DAI-ICHI KOGYO SEIYAKU CO., LTD.) | 2 g |
| Ion-exchanged water | 78 g |

The above components were mixed, and the mixture was dispersed by using an ultrasonic cleaner at an oscillatory frequency of 26 kHz for 10 minutes, whereby a colorant particle-dispersed liquid (anionic) 1 was prepared.

| Preparation of mixed liquid | |
|---|---|
| Resin particle-dispersed liquid 1 | 180 g |
| Resin particle-dispersed liquid 2 | 80 g |
| Colorant particle-dispersed liquid 1 | 30 g |
| Release agent particle-dispersed liquid 1 | 50 g |

The above components were mixed and dispersed in a round bottom flask made of stainless steel by using a homogenizer or the like, whereby a mixed liquid was prepared.

Formation of Aggregated Particles 1.2 g of a cationic surfactant (SANISOL B50, manufactured by KAO CORPORATION) as an flocculent were added to the above mixed liquid, and the whole was heated to 50° C. in an oil bath for heating while the inside of the flask was stirred. After the resultant had been held at 50° C. for 1 hour, the resultant was observed with an optical microscope. As a result, the formation of aggregated particles having a weight average particle diameter of about 4.8 μm was observed.

Fusion

After that, 3 g of an anionic surfactant (NEOGEN SC, manufactured by DAI-ICHI KOGYO SEIYAKU CO., LTD.) were added to the mixed liquid containing the aggregated particles. After that, the flask made of stainless steel was hermetically sealed, and then the mixture was heated to 105° C. while the mixture was continuously stirred by using a magnetic seal. The temperature was held for 3 hours. Then, after the temperature had been cooled, the reaction product was filtered, sufficiently washed with ion-exchanged water, and dried, whereby cyan particles 8 (toner particles) were obtained.

After that, external addition was performed in the same manner as in Example 1, whereby Toner 8 having physical properties shown in Tables 2 and 3 was obtained. Toner 8 thus obtained had a weight average particle diameter of 5.5 μm, and the peak molecular weight (Mp) of THF soluble matter determined by means of GPC was 16,500. The toner was evaluated for each of various items in the same manner as in Example 1. As a result, as shown in Table 4, the toner was poor in a void.

Comparative Example 5

Toner 9 having physical properties shown in Tables 2 and 3 was obtained in the same manner as in Toner 5 except that a condition for the heat spheroidization treatment in Comparative Example 1 was changed in such a manner that the treatment would be performed with hot air having a temperature of 250° C. The toner was evaluated for each of various items in the same manner as in Example 1. As a result, as shown in Table 4, the toner was poor in fixability.

TABLE 2

| | Degree of aggregation | | | Highest endothermic | Mean |
|---|---|---|---|---|---|
| | At the time of compression Y1 | At the time of non-compression Y2 | Kind of wax | peak temperature (° C.) | valley depth (nm) |
| Toner 1 | 26 | 12 | Purified paraffin | 70 | 155 |
| Toner 2 | 19 | 10 | Polyethylene | 99 | 150 |
| Toner 3 | 15 | 7 | Polyethylene | 126 | 120 |
| Toner 4 | 35 | 15 | Stearyl stearate | 64 | 199 |
| Toner 5 | 8 | 5 | Polypropylene | 147 | 106 |
| Toner 6 | 55 | 19 | Palmityl palmitate | 53 | 265 |
| Toner 7 | 41 | 10 | Purified paraffin | 70 | 212 |
| Toner 8 | 50 | 46 | Polyethylene | 89 | 230 |
| Toner 9 | 29 | 12 | Polypropylene | 147 | 125 |

TABLE 3

| | Weight average particle diameter | Grain size distribution (number %) | | | Average circularity | | | |
|---|---|---|---|---|---|---|---|---|
| | (μm) | 2.00-3.00 μm | 3.00-6.92 μm | 6.92-12.66 μm | R | r(a) | r(b) | r(c) |
| Toner 1 | 5.3 | 4.9 | 83.6 | 11.5 | 0.954 | 0.954 | 0.954 | 0.957 |
| Toner 2 | 5.5 | 4.3 | 82.5 | 13.2 | 0.956 | 0.955 | 0.956 | 0.958 |
| Toner 3 | 5.3 | 5.1 | 84.0 | 10.9 | 0.967 | 0.966 | 0.967 | 0.968 |
| Toner 4 | 5.3 | 5.1 | 83.8 | 11.1 | 0.945 | 0.944 | 0.944 | 0.953 |
| Toner 5 | 5.6 | 4.1 | 77.7 | 18.2 | 0.976 | 0.980 | 0.978 | 0.968 |
| Toner 6 | 5.5 | 4.4 | 81.6 | 14.0 | 0.926 | 0.930 | 0.928 | 0.910 |
| Toner 7 | 5.6 | 5.3 | 82.1 | 12.6 | 0.937 | 0.936 | 0.938 | 0.929 |
| Toner 8 | 5.5 | 0.7 | 82.6 | 16.7 | 0.958 | 0.946 | 0.962 | 0.939 |
| Toner 9 | 5.6 | 4.1 | 78.8 | 17.1 | 0.966 | 0.975 | 0.969 | 0.951 |

TABLE 4

| | Scattering | Void | Fixable region | Blocking | Fog |
|---|---|---|---|---|---|
| Example 1 | A | A | 150-210° C. | A | A |
| Example 2 | A | A | 175-210° C. | A | B |
| Example 3 | C | A | 175-210° C. | A | B |
| Example 4 | A | C | 145-205° C. | C | C |
| Comparative example 1 | D | A | 180-210° C. | A | C |
| Comparative example 2 | A | E | 140-185° C. | E | E |
| Comparative example 3 | A | D | 150-210° C. | A | B |
| Comparative example 4 | A | D | 165-210° C. | A | B |
| Comparative example 5 | A | A | 185-210° C. | A | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-323390, filed Nov. 8, 2005 which is hereby incorporated by reference herein in its entirety.

What is claimed is:

1. A toner comprising at least:

toner particles each containing at least a binder resin, a release agent, and a colorant; and an inorganic fine powder, wherein:

(i) a degree of aggregation Y1 at a time of compression (200 kPa) of the toner satisfies a relationship of $15 \leqq Y1 \leqq 35$, and a degree of aggregation Y2 at a time of non-compression of the toner satisfies a relationship of $7 \leqq Y2 \leqq 15$; and (ii) a highest endothermic peak of the toner is present in a temperature range of 30 to 200° C. in an endothermic curve measured with a differential scanning calorimeter (DSC), and a peak temperature Tsc (° C.) of the highest endothermic peak satisfies a relationship of $60 \leqq Tsc \leqq 130$.

2. A toner according to claim 1, wherein:

a weight average particle diameter (D4) of the toner is 3.0 μm to 7.0 μm; and when an average circularity of toner having a circle-equivalent diameter of 2.00 μm or more is represented by R, an average circularity of toner having a circle-equivalent diameter in a range of 2.00 μm or more to less than 3.00 μm is represented by r(a), an average circularity of toner having a circle-equivalent diameter in a range of 3.00 μm or more to less than 6.92 μm is represented by r(b), and an average circularity of toner having a circle-equivalent diameter in a range of 6.92 μm or more to less than 12.66 μm is represented by r(c), R, r(a), r(b), and r(c) satisfy relationships represented by expressions (1) to (4):

$$0.940 \leqq R \leqq 0.970 \quad \text{Ex. (1)}$$

$$R-0.015 \leqq r(a) \leqq R+0.015 \quad \text{Ex. (2)}$$

$$R-0.015 \leqq r(b) \leqq R+0.015 \quad \text{Ex. (3)}$$

$$R-0.015 \leqq r(c) \leqq R+0.015 \quad \text{Ex. (4).}$$

3. A toner according to claim 1, wherein the inorganic fine powder contains at least an inorganic fine powder (A) having a number average particle diameter of 20 nm or more to less than 300 nm and an inorganic fine powder (B) having a number average particle diameter of 5 nm or more to less than 20 nm, and a surface of at least one of the inorganic fine powder (A) and the inorganic fine powder (B) is treated with silicone oil.

4. An image forming method comprising:

a charging step of charging an image bearing member;

a latent image formation step of forming an electrostatic latent image on the image bearing member charged in the charging step;

a development step of developing the electrostatic latent image formed on the image bearing member with toner to form a toner image;

a transfer step of transferring the toner image on the image bearing member onto a transfer material through an intermediate transfer member; and a fixation step of fixing the toner image to the transfer material by bringing the toner image into press contact with the transfer material at a fixation nip portion, wherein:

a contact pressure at the fixation nip portion is 5.0 to 11.0 $N/m^2$; and the toner comprises the toner according to any one of claims 1 to 3.

* * * * *